US011376844B2

(12) United States Patent
Kashimura et al.

(10) Patent No.: US 11,376,844 B2
(45) Date of Patent: Jul. 5, 2022

(54) DRIVE CIRCUIT AND LIQUID EJECTING APPARATUS

(71) Applicant: Seiko Epson Corporation, Tokyo (JP)

(72) Inventors: Toru Kashimura, Shiojiri (JP); Yoichiro Kondo, Chino (JP)

(73) Assignee: Seiko Epson Corporation

( * ) Notice: Subject to any disclaimer, the term of this patent is extended or adjusted under 35 U.S.C. 154(b) by 0 days.

(21) Appl. No.: 17/005,687

(22) Filed: Aug. 28, 2020

(65) Prior Publication Data

US 2021/0060931 A1 Mar. 4, 2021

(30) Foreign Application Priority Data

Aug. 30, 2019 (JP) ..... JP2019-157936

(51) Int. Cl.
*B41J 29/393* (2006.01)
*B41J 2/045* (2006.01)
*B41J 2/14* (2006.01)

(52) U.S. Cl.
CPC ..... *B41J 2/04541* (2013.01); *B41J 2/04581* (2013.01); *B41J 2/04593* (2013.01); *B41J 2/14233* (2013.01)

(58) Field of Classification Search
CPC . B41J 2/14233; B41J 2/04581; B41J 2/04541
See application file for complete search history.

(56) References Cited

U.S. PATENT DOCUMENTS

| | | | | |
|---|---|---|---|---|
| 10,000,059 | B2 * | 6/2018 | Kondo | B41J 2/14233 |
| 10,160,201 | B2 | 12/2018 | Nakajima | |
| 2016/0207340 | A1 * | 7/2016 | Takano | B41J 2/0451 |
| 2017/0120584 | A1 | 5/2017 | Kondo | |
| 2019/0232656 | A1 | 8/2019 | Matsumoto | |

FOREIGN PATENT DOCUMENTS

| | | | |
|---|---|---|---|
| CN | 110091600 | A | 8/2019 |
| EP | 3045314 | A2 | 7/2016 |
| JP | 2016-135585 | A | 7/2016 |
| JP | 2017-081029 | A | 5/2017 |
| JP | 2018-099865 | A | 6/2018 |

* cited by examiner

*Primary Examiner* — Lam S Nguyen
(74) *Attorney, Agent, or Firm* — Harness, Dickey & Pierce, P.L.C.

(57) ABSTRACT

A drive circuit for driving a first drive element having a first terminal and a second terminal and driving a second drive element having a third terminal and a fourth terminal, includes a first drive signal output circuit that is electrically coupled to the first terminal and outputs a first drive signal, a second drive signal output circuit that is electrically coupled to the third terminal and outputs a second drive signal, a reference voltage signal output circuit that outputs a reference voltage signal having a constant reference voltage value, and a first switch circuit having one end electrically coupled to an output terminal of the reference voltage signal output circuit and the other end electrically coupled to the second terminal and the fourth terminal. The first switch circuit switches whether or not to supply a second constant voltage signal to the second terminal and the fourth terminal.

5 Claims, 18 Drawing Sheets

| | | LARGE DOT | MEDIUM DOT | SMALL DOT | MICRO-VIBRATION |
|---|---|---|---|---|---|
| [SIH, SIL] | | [1, 1] | [1, 0] | [0, 1] | [0, 0] |
| S | T1 | H | H | L | L |
| | T2 | H | L | H | L |
| | T3 | L | L | L | H |

DRIVE CIRCUIT AND LIQUID EJECTING APPARATUS

The present application is based on, and claims priority from JP Application Serial Number 2019-157936, filed Aug. 30, 2019, the disclosure of which is hereby incorporated by reference here in its entirety.

BACKGROUND

1. Technical Field

The present disclosure relates to a drive circuit and a liquid ejecting apparatus.

2. Related Art

It is known that an ink jet printer which is an example of a liquid ejecting apparatus ejecting a liquid such as ink to print an image or a document uses a piezoelectric element such as a piezo element. The piezoelectric element in a print head is provided to correspond to a plurality of nozzles for ejecting ink and a cavity for storing the ink ejected from the nozzles. As the piezoelectric element is displaced according to a drive signal, a vibration plate provided between the piezoelectric element and the cavity bends, and a volume of the cavity changes. Thereby, a predetermined amount of ink is ejected from the nozzles at a predetermined timing, and dots are formed on a medium.

For example, JP-A-2018-099865 discloses a liquid ejecting apparatus that includes a plurality of print heads including a plurality of drive modules. Furthermore, in the liquid ejecting apparatus described in JP-A-2018-099865, each drive module includes a plurality of ejecting sections and a plurality of piezoelectric elements corresponding to the ejecting sections. In the liquid ejecting apparatus described in JP-A-2018-099865, a drive signal output from the corresponding drive circuit is supplied to one end of each piezoelectric element, a reference voltage signal is supplied to the other end thereof, and thereby, the piezoelectric element is driven to eject ink of an amount based on the drive of the piezoelectric element from an ejecting section, and thus, dots are formed on a medium.

However, in a liquid ejecting apparatus including a plurality of drive modules including a plurality of piezoelectric elements, such as the liquid ejecting apparatus described in JP-A-2018-099865, variation is generated in driving each piezoelectric element when a supplied reference voltage signal varies among the plurality of drive modules, and thus, variation is generated in ejection characteristics of ink among the drive modules. As a result, an ink ejection accuracy of a print head including a plurality of drive modules may be reduced.

That is, in the liquid ejecting apparatus described in JP-A-2018-099865, the liquid ejecting apparatus including a plurality of drive element groups, each group including a plurality of ejecting sections, each ejecting section including a drive element such as a piezoelectric element, has room for improvement from the viewpoint of increasing a drive accuracy of the drive element.

SUMMARY

In one aspect of a drive circuit according to the present disclosure, a drive circuit for driving a first drive element having a first terminal and a second terminal and driving a second drive element having a third terminal and a fourth terminal, includes a first drive signal output circuit that is electrically coupled to the first terminal and outputs a first drive signal for driving the first drive element, a second drive signal output circuit that is electrically coupled to the third terminal and outputs a second drive signal for driving the second drive element, a reference voltage signal output circuit that is electrically coupled to the second terminal and the fourth terminal and outputs a reference voltage signal having a constant reference voltage value, and a first switch circuit having one end electrically coupled to an output terminal of the reference voltage signal output circuit and the other end electrically coupled to the second terminal and the fourth terminal, in which the first switch circuit switches whether or not to supply the reference voltage signal to the second terminal and the fourth terminal.

In the one aspect of the drive circuit, whether or not to supply the reference voltage signal to the second terminal and the fourth terminal may be switched by controlling conduction or non-conduction between one end of the first switch circuit and the other end of the first switch circuit.

In the one aspect of the drive circuit, the first drive signal output circuit may output a first control signal for controlling the first switch circuit, the second drive signal output circuit may output a second control signal for controlling the first switch circuit, and the first switch circuit may switch whether or not to supply the reference voltage signal to the second terminal and the fourth terminal according to the first control signal and the second control signal.

In the one aspect of the drive circuit, when at least one of the first control signal and the second control signal is a signal indicating that the reference voltage signal is not supplied to the second terminal and the fourth terminal, the first switch circuit may not supply the reference voltage signal to the second terminal and the fourth terminal.

In the one aspect of the drive circuit, the drive circuit may further include a third drive element having a fifth terminal and a sixth terminal, and a fourth drive element having a seventh terminal and an eighth terminal, and the drive circuit may further include a third drive signal output circuit that is electrically coupled to the fifth terminal and outputs a third drive signal for driving the third drive element, a fourth drive signal output circuit that is electrically coupled to the seventh terminal and outputs a fourth drive signal for driving the fourth drive element, and a second switch circuit having one end electrically coupled to an output terminal of the reference voltage signal output circuit and the other end electrically coupled to the sixth terminal and the eighth terminal, and the second switch circuit may switch whether or not to supply the reference voltage signal to the sixth terminal and the eighth terminal.

One aspect of a liquid ejecting apparatus according to the present disclosure includes one aspect of the drive circuit, and a liquid ejecting head that includes the first drive element and the second drive element and ejects a liquid by driving at least one of the first drive element and the second drive element.

DESCRIPTION OF EXEMPLARY EMBODIMENTS

Hereinafter, preferred embodiments of the present disclosure will be described with reference to the drawings. The drawings are used for the sake of convenient description. The embodiments which will be described below do not unduly limit contents of the present disclosure described in claims. Further, all configurations which will be described below are not necessarily essential configuration elements of the disclosure.

1. Configuration of Liquid Ejecting Apparatus

A printing apparatus which is an example of a liquid ejecting apparatus according to the present embodiment is an ink jet printer that prints an image including characters, figures, and the like according to image data onto a medium such as paper by ejecting ink from nozzles according to the image data input from an external host computer or the like.

Figure 1:
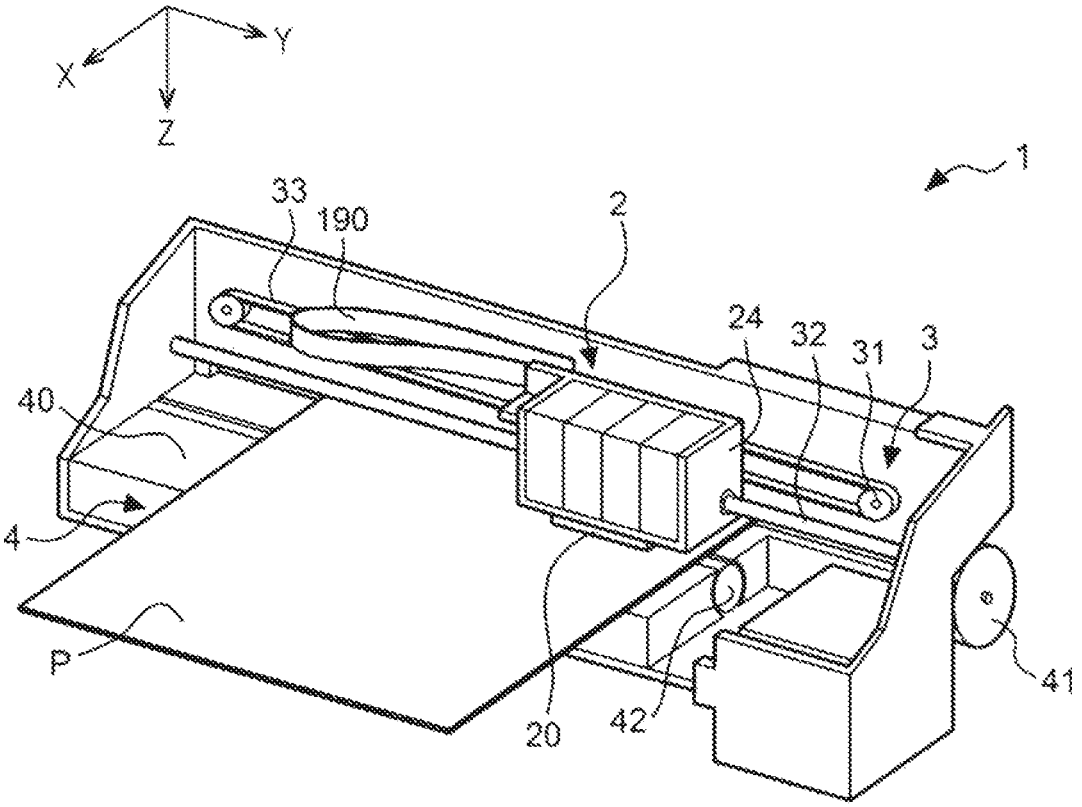
FIG. 1 is a diagram illustrating a schematic configuration of a liquid ejecting apparatus.

FIG. 1 is a diagram illustrating a schematic configuration of a liquid ejecting apparatus 1. FIG. 1 illustrates a direction X in which a medium P is transported, a direction Y which intersects with the direction X and in which a moving object 2 reciprocates, and a direction Z in which ink is ejected. Hereinafter, the direction X, the direction Y, and the direction Z are described as being orthogonal to each other, but a configuration included in the liquid ejecting apparatus 1 is not limited to being disposed to be orthogonal to each other. Further, in the following description, the direction Y in which the moving object 2 moves may be referred to as a main scanning direction, and the direction X in which the medium P is transported may be referred to as a transport direction.

As illustrated in FIG. 1, the liquid ejecting apparatus 1 includes the moving object 2 and a moving mechanism 3 that reciprocates the moving object 2 in the direction Y. The moving mechanism 3 includes a carriage motor 31 serving as a drive source of the moving object 2, a carriage guide shaft 32 having both ends fixed, and a timing belt 33 which extends substantially parallel to the carriage guide shaft 32 and is driven by the carriage motor 31.

The carriage 24 included in the moving object 2 is supported by a carriage guide shaft 32 so as to be able to reciprocate and is fixed to a part of the timing belt 33. The timing belt 33 is driven by the carriage motor 31, and thereby, the carriage 24 is guided by the carriage guide shaft 32 to reciprocate in the direction Y. Further, a head unit 20 including many nozzles is provided in a part of the moving object 2 facing the medium P. A control signal and the like are input to the head unit 20 via a cable 190. Then, the head unit 20 ejects ink which is an example of a liquid from the nozzles based on the control signal which is input.

The liquid ejecting apparatus 1 includes a transport mechanism 4 that transports the medium P on the platen 40 in the direction X. The transport mechanism 4 includes a transport motor 41 that is a drive source, and a transport roller 42 that is rotated by the transport motor 41 to transport the medium P in the direction X.

In the liquid ejecting apparatus 1 configured as described above, an image is formed on a surface of the medium P by ejecting ink from the head unit 20 at a timing when the medium P is transported by the transport mechanism 4.

2. Electrical Configuration of Liquid Ejecting Apparatus

Figure 2:
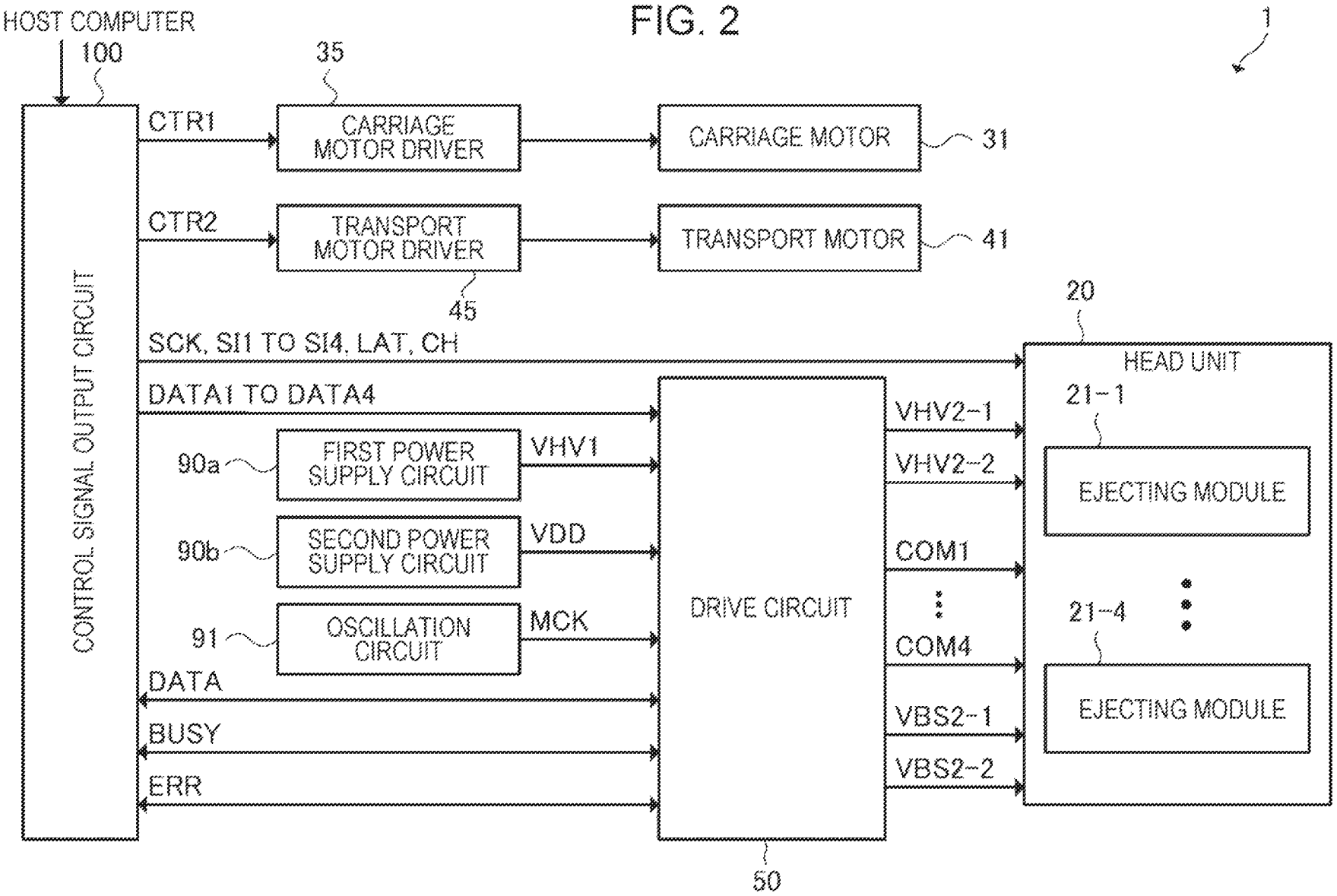
FIG. 2 is a diagram illustrating an electrical configuration of the liquid ejecting apparatus.

FIG. 2 is a diagram illustrating an electrical configuration of the liquid ejecting apparatus 1. As illustrated in FIG. 2, the liquid ejecting apparatus 1 includes a control signal output circuit 100, a carriage motor driver 35, the carriage motor 31, a transport motor driver 45, the transport motor 41, a drive circuit 50, a first power supply circuit 90*a*, and a second power supply circuit 90*b*, an oscillation circuit 91, and a head unit 20.

The control signal output circuit 100 generates a plurality of control signals for controlling various configuration elements based on image data input from a host computer, and outputs the signals to the corresponding configuration elements. Specifically, the control signal output circuit 100 generates a control signal CTR1 and outputs the control signal CTR1 to the carriage motor driver 35. The carriage motor driver 35 drives the carriage motor 31 according to the input control signal CTR1. Thereby, movement of the carriage 24 in the direction Y is controlled. Further, the control signal output circuit 100 generates a control signal CTR2 and outputs the control signal CTR2 to the transport motor driver 45. The transport motor driver 45 drives the transport motor 41 according to the input control signal CTR2. Thereby, transport of the medium P in the direction X is controlled.

Further, the control signal output circuit 100 generates drive data signals DATA1 to DATA4 for controlling an operation of the drive circuit 50 and outputs the drive data signal to the drive circuit 50. Further, state signal BUSY and abnormality signal ERR are mutually propagated between the control signal output circuit 100 and the drive circuit 50. Further, the control signal output circuit 100 generates a clock signal SCK, printing data signal SI1 to SI4, a latch signal LAT, and a change signal CH that are used for controlling an operation of the head unit 20, and outputs the generated signals to the head unit 20.

The first power supply circuit 90*a* generates a voltage signal VHV1 having a voltage value of, for example, DC 42 V. The first power supply circuit 90*a* outputs the voltage signal VHV1 to the drive circuit 50. The second power supply circuit 90*b* generates a voltage signal VDD having a voltage value of, for example, DC 3.3 V. The second power supply circuit 90*b* outputs the voltage signal VDD to the drive circuit 50. The voltage signals VHV1 and VDD may be used as drive voltages of respective sections included in the liquid ejecting apparatus 1. Further, the first power supply circuit 90*a* and the second power supply circuit 90*b* may output a plurality of voltage signals having voltage values different from the voltage signal VHV1 having the above-described voltage value and the voltage signal VDD.

The oscillation circuit 91 generates a clock signal MCK and outputs the clock signal MCK to the drive circuit 50. Here, the oscillation circuit 91 may be provided independently of the control signal output circuit 100 as illustrated in FIG. 2 or may be provided inside the control signal output circuit 100. Furthermore, the clock signal MCK output from the oscillation circuit 91 may be supplied to respective sections included in the liquid ejecting apparatus 1 in addition to the drive circuit 50.

The drive circuit 50 generates drive signals COM1 to COM4 by amplifying signals having waveforms respectively defined by the drive data signals DATA1 to DATA4 to a voltage value based on the voltage signal VHV1, and outputs the drive signals to the head unit 20. Further, the drive circuit 50 generates reference voltage signals VBS2-1 and VBS2-2 and outputs the reference voltage signals to the head unit 20. Furthermore, the drive circuit 50 propagates the voltage signal VHV1 input from the first power supply circuit 90*a*, branches the voltage signal, and outputs the divided voltage signals as voltage signals VHV2-1 and VHV2-2.

The head unit 20 includes ejecting modules 21-1 to 21-4. The ejecting modules 21-1 to 21-4 receive the clock signals SCK, the printing data signals SI1 to SI4, the latch signal LAT, and the change signal CH, and receive the voltage signals VHV2-1 and VHV2-2, the drive signals COM1 to COM4, and the reference voltage signals VBS2-1 and VBS2-2 output from the drive circuit 50. The head unit 20 ejects a predetermined amount of ink at a desired timing based on input various signals.

Figure 3A:
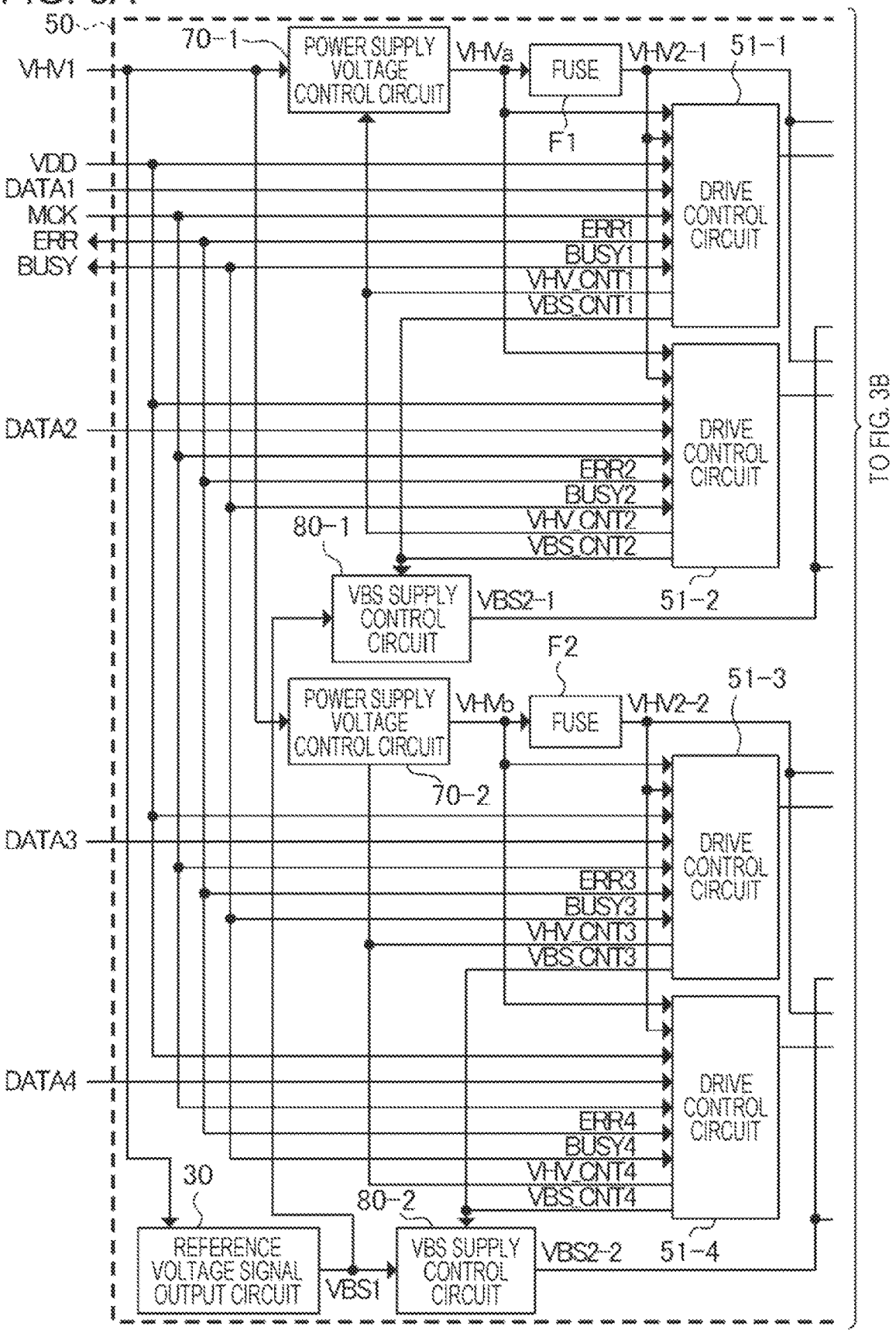
FIG. 3A is a first half of a diagram illustrating an example of configurations and electrical coupling of a drive circuit and a head unit.
Figure 3B:
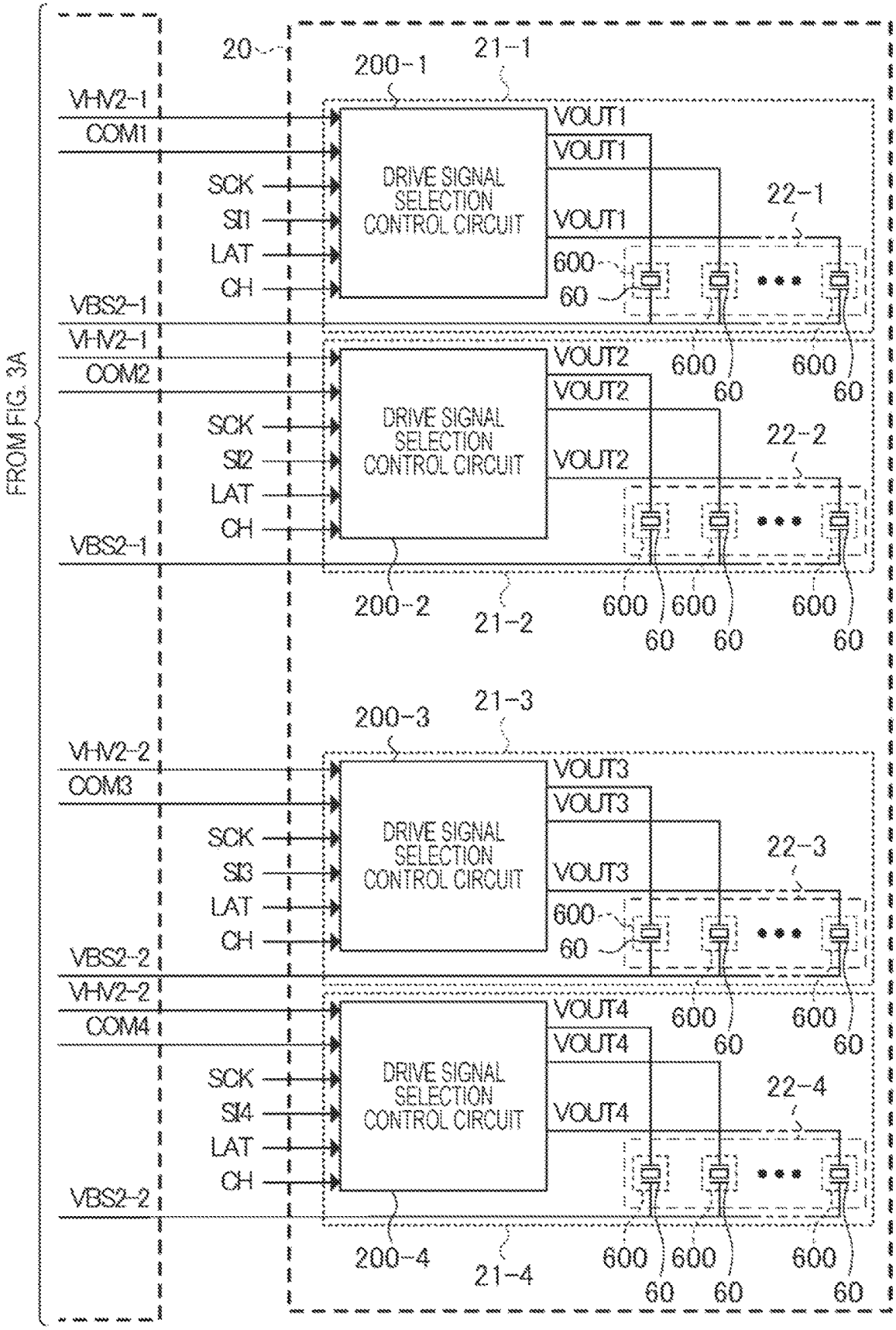
FIG. 3B is a second half of the diagram illustrating the example of the configurations and electrical coupling of the drive circuit and the head unit.

Here, configurations and electrical coupling of the drive circuit 50 and the head unit 20 will be described with reference to FIGS. 3A and 3B. FIGS. 3A and 3B are diagrams illustrating an example of the configurations and electrical coupling of the drive circuit 50 and the head unit 20.

As illustrated in FIG. 3A, the drive circuit 50 includes power supply voltage control circuits 70-1 and 70-2, VBS supply control circuits 80-1 and 80-2, a reference voltage signal output circuit 30, drive control circuits 51-1 to 51-4, and fuses F1 and F2.

The voltage signal VHV1 is input to the power supply voltage control circuit 70-1 from the first power supply circuit 90*a*. The power supply voltage control circuit 70-1 switches whether or not to output the input voltage signal VHV1 as a voltage signal VHVa. The voltage signal VHVa output from the power supply voltage control circuit 70-1 is input to the fuse F1. The voltage signal VHVa input to the fuse F1 is output from the fuse F1 as the voltage signal VHV2-1. The voltage signal VHV2-1 is output to the head unit 20 after being branched by the drive circuit 50. Further, the voltage signals VHVa and VHV2-1 are also input to the drive control circuits 51-1 and 51-2.

Likewise, the voltage signal VHV1 is input to the power supply voltage control circuit 70-2 from the first power supply circuit 90*a*. The power supply voltage control circuit 70-2 switches whether or not to output the input voltage signal VHV1 as a voltage signal VHVb. The voltage signal VHVb output from the power supply voltage control circuit 70-2 is input to the fuse F2. The voltage signal VHVb input to the fuse F2 is output from the fuse F2 as the voltage signal VHV2-2. The voltage signal VHV2-2 is output to the head unit 20 after being branched by the drive circuit 50. Further, the voltage signals VHVb and VHV2-2 are also input to the drive control circuits 51-3 and 51-4.

The reference voltage signal output circuit 30 generates the reference voltage signal VBS1 by dropping a voltage of the voltage signal VHV1. A voltage value of the reference voltage signal VBS1 may be, for example, DC 6 V, DC 5.5 V, or the like, or may be a ground potential. The reference voltage signal output circuit 30 may be configured to drop a voltage of the voltage signal VHV1 as described above, or may be configured to boost a voltage of the voltage signal VDD. Further, the reference voltage signal output circuit 30 may generate the reference voltage signal VBS1 by boosting or dropping a voltage of a signal having a voltage value different from voltage values of the voltage signal VHV and the voltage signal VDD.

The reference voltage signal VBS1 is input from the reference voltage signal output circuit 30 to the VBS supply control circuit 80-1. The VBS supply control circuit 80-1 switches whether or not to output the input reference voltage signal VBS1 as the reference voltage signal VBS2-1. The reference voltage signal VBS2-1 output from the VBS supply control circuit 80-1 is output to the head unit 20 after being branched by the drive circuit 50.

The reference voltage signal VBS1 is input to the VBS supply control circuit 80-2 from the reference voltage signal output circuit 30. The VBS supply control circuit 80-2 switches whether or not to output the input reference voltage signal VBS1 as the reference voltage signal VBS2-2. The reference voltage signal VBS2-2 output from the VBS supply control circuit 80-2 is output to the head unit 20 after being branched by the drive circuit 50.

The drive control circuit 51-1 receives the voltage signal VDD output from the second power supply circuit 90*b*, the clock signal MCK output from the oscillation circuit 91, and the drive data signal DATA1 output from the control signal output circuit 100 in addition to the voltage signals VHVa and VHV2-1 described above. The drive control circuit 51-1 generates the drive signal COM1 based on the voltage signals VHVa, VHV2-1, and VDD, the clock signal MCK, and the drive data signal DATA1 which are input, and outputs the drive signal COM1 to the head unit 20. Furthermore, the drive control circuit 51-1 receives the abnormality signal ERR and the state signal BUSY, and outputs an abnormality signal ERR1 indicating whether or not the drive control circuit 51-1 is abnormal and a state signal BUSY1 indicating an operation state. Further, the drive control circuit 51-1 outputs a VHV control signal VHV_CNT1 for controlling the power supply voltage control circuit 70-1 and a VBS control signal VBS_CNT1 for controlling the VBS supply control circuit 80-1.

The drive control circuit 51-2 receives the voltage signal VDD output from the second power supply circuit 90*b*, the clock signal MCK output from the oscillation circuit 91, and the drive data signal DATA2 output from the control signal output circuit 100 in addition to the voltage signals VHVa and VHV2-1 described above. The drive control circuit 51-2 generates the drive signal COM2 based on the voltage signals VHVa, VHV2-1, and VDD, the clock signal MCK, and the drive data signal DATA2 which are input, and outputs the drive signal COM2 to the head unit 20. Furthermore, the drive control circuit 51-2 receives the abnormality signal ERR and the state signal BUSY, and outputs an abnormality signal ERR2 indicating whether or not the drive control circuit 51-2 is abnormal and a state signal BUSY2 indicating an operation state. Further, the drive control circuit 51-2 outputs a VHV control signal VHV_CNT2 for controlling the power supply voltage control circuit 70-1 and a VBS control signal VBS_CNT2 for controlling the VBS supply control circuit 80-1.

The drive control circuit 51-3 receives the voltage signal VDD output from the second power supply circuit 90*b*, the clock signal MCK output from the oscillation circuit 91, and the drive data signal DATA3 output from the control signal output circuit 100 in addition to the voltage signals VHVb and VHV2-2 described above. The drive control circuit 51-3 generates the drive signal COM3 based on the voltage signals VHVb, VHV2-2, and VDD, the clock signal MCK, and the drive data signal DATA3 which are input, and outputs the drive signal COM3 to the head unit 20. Furthermore, the drive control circuit 51-3 receives the abnormality signal ERR and the state signal BUSY, and outputs an abnormality signal ERR3 indicating whether or not the drive control circuit 51-3 is abnormal and a state signal BUSY3 indicating an operation state. Further, the drive control circuit 51-3 outputs a VHV control signal VHV_CNT3 for controlling the power supply voltage control circuit 70-2 and a VBS control signal VBS_CNT3 for controlling the VBS supply control circuit 80-2.

The drive control circuit 51-4 receives the voltage signal VDD output from the second power supply circuit 90*b*, the clock signal MCK output from the oscillation circuit 91, and the drive data signal DATA4 output from the control signal output circuit 100 in addition to the voltage signals VHVb and VHV2-2 described above. The drive control circuit 51-4 generates the drive signal COM4 based on the voltage signals VHVb, VHV2-2, and VDD, the clock signal MCK, and the drive data signal DATA4 which are input, and outputs the drive signal COM4 to the head unit 20. Furthermore, the drive control circuit 51-4 receives the abnormality signal ERR and the state signal BUSY, and outputs an abnormality signal ERR4 indicating whether or not the drive control circuit 51-4 is abnormal and a state signal BUSY4 indicating an operation state. Further, the drive control circuit 51-4 outputs a VHV control signal VHV_CNT4 for controlling the power supply voltage control circuit 70-2 and a VBS control signal VBS_CNT4 for controlling the VBS supply control circuit 80-2.

The head unit 20 includes ejecting modules 21-1 to 21-4.

The ejecting module 21-1 includes a drive signal selection control circuit 200-1 and a head 22-1. The ejecting module 21-1 receives the voltage signal VHV2-1, the drive signal COM1, the reference voltage signal VBS2-1, the clock signal SCK, the printing data signal SI1, the latch signal LAT, and the change signal CH. The drive signal selection control circuit 200-1 selects or deselects a signal waveform included in the drive signal COM1 at the timing defined by the clock signal SCK, the printing data signal SI1, the latch signal LAT and the change signal CH to generate a drive signal VOUT1 and outputs the generated drive signal to the head 22-1.

The head 22-1 includes a plurality of ejecting sections 600. Further, each ejecting section 600 includes a piezoelectric element 60. The drive signal VOUT1 output from the drive signal selection control circuit 200-1 is supplied to one end of the piezoelectric element 60, and the reference voltage signal VBS2-1 is supplied to the other end of the piezoelectric element 60. The piezoelectric element 60 is driven by a potential difference between the drive signal VOUT1 and the reference voltage signal VBS2-1. Thereby, ink is ejected from the corresponding ejecting section 600.

The ejecting module 21-2 includes a drive signal selection control circuit 200-2 and a head 22-2. The ejecting module 21-2 receives the voltage signal VHV2-1, the drive signal COM2, the reference voltage signal VBS2-1, the clock signal SCK, the printing data signal SI2, the latch signal LAT, and the change signal CH. The drive signal selection control circuit 200-2 selects or deselects a signal waveform included in the drive signal COM2 at the timing defined by the clock signal SCK, the printing data signal SI2, the latch signal LAT, and the change signal CH to generate a drive signal VOUT2 and outputs the generated drive signal to the head 22-2.

The head 22-2 includes a plurality of ejecting sections 600. Further, each ejecting section 600 includes a piezoelectric element 60. The drive signal VOUT2 output from the drive signal selection control circuit 200-2 is supplied to one end of the piezoelectric element 60, and the reference voltage signal VBS2-1 is supplied to the other end of the piezoelectric element 60. The piezoelectric element 60 is driven by a potential difference between the drive signal VOUT2 and the reference voltage signal VBS2-1. Thereby, ink is ejected from the corresponding ejecting section 600.

The ejecting module 21-3 includes a drive signal selection control circuit 200-3 and a head 22-3. The ejecting module 21-3 receives the voltage signal VHV2-2, the drive signal COM3, the reference voltage signal VBS2-2, the clock signal SCK, the printing data signal SI3, the latch signal LAT, and the change signal CH. The drive signal selection control circuit 200-3 selects or deselects a signal waveform included in the drive signal COM3 at the timing defined by the clock signal SCK, the printing data signal SI3, the latch signal LAT, and the change signal CH to generate a drive signal VOUT3 and outputs the generated drive signal to the head 22-3.

The head 22-3 includes a plurality of ejecting sections 600. Further, each ejecting section 600 includes a piezoelectric element 60. The drive signal VOUT3 output from the drive signal selection control circuit 200-3 is supplied to one end of the piezoelectric element 60, and the reference voltage signal VBS2-2 is supplied to the other end of the piezoelectric element 60. The piezoelectric element 60 is driven by a potential difference between the drive signal VOUT3 and the reference voltage signal VBS2-2. Thereby, ink is ejected from the corresponding ejecting section 600.

The ejecting module 21-4 includes a drive signal selection control circuit 200-4 and a head 22-4. The ejecting module 21-4 receives the voltage signal VHV2-2, the drive signal COM4, the reference voltage signal VBS2-2, the clock signal SCK, the printing data signal SI4, the latch signal LAT, and the change signal CH. The drive signal selection control circuit 200-4 selects or deselects a signal waveform included in the drive signal COM4 at the timing defined by the clock signal SCK, the printing data signal SI4, the latch signal LAT, and the change signal CH to generate a drive signal VOUT4 and outputs the generated drive signal to the head 22-4.

The head 22-4 includes a plurality of ejecting sections 600. Further, each ejecting section 600 includes a piezoelectric element 60. The drive signal VOUT4 output from the drive signal selection control circuit 200-4 is supplied to one end of the piezoelectric element 60, and the reference voltage signal VBS2-2 is supplied to the other end of the piezoelectric element 60. The piezoelectric element 60 is driven by a potential difference between the drive signal VOUT4 and the reference voltage signal VBS2-2. Thereby, ink is ejected from the corresponding ejecting section 600.

Here, any one of the plurality of piezoelectric elements 60 included in the head 22-1 is an example of a first drive element, any one of the plurality of piezoelectric elements 60 included in the head 22-2 is an example of a second drive element, any one of the plurality of piezoelectric elements 60 included in the head 22-3 is an example of a third drive element, and any one of the plurality of piezoelectric elements 60 included in the head 22-4 is an example of a fourth drive element. Further, the drive circuit 50 drives the plurality of piezoelectric elements 60 included in the heads 22-1 to 22-4. The head unit 20 that ejects ink as a liquid by driving the plurality of piezoelectric elements 60 included in the heads 22-1 to 22-4 is an example of a liquid ejecting head.

Here, the power supply voltage control circuits 70-1 and 70-2 have the same configuration, and in the following description, when it is not necessary to distinguish therebetween, the power supply voltage control circuits 70-1 and 70-2 are simply referred to as a power supply voltage control circuit 70. Likewise, the VBS supply control circuits 80-1 and 80-2 have the same configuration, and in the following description, when it is not necessary to distinguish therebetween, the VBS supply control circuits 80-1 and 80-2 are simply referred to as a VBS supply control circuit 80. Likewise, the drive control circuits 51-1 to 51-4 have the same configuration, and in the following description, when it is not necessary to distinguish therebetween, the drive control circuits 51-1 to 51-4 are simply referred to as a drive control circuit 51. Likewise, the fuses F1 and F2 have the same configuration, and in the following description, when it is not necessary to distinguish therebetween, the fuses F1 and F2 are simply referred to as a fuse F. Likewise, the ejecting modules 21-1 to 21-4 have the same configuration, and in the following description, when it is not necessary to distinguish therebetween, the ejecting modules 21-1 to 21-4 are simply referred to as an ejecting module 21. Likewise, the drive signal selection control circuits 200-1 to 200-4 have the same configuration, and in the following description, when it is not necessary to distinguish therebetween, the drive signal selection control circuits 200-1 to 200-4 are simply referred to as a drive signal selection control circuit 200. Likewise, the heads 22-1 to 22-4 have the same configuration, and in the following description, when it is not necessary to distinguish therebetween, the heads 22-1 to 22-4 are simply referred to as a head 22.

It will be described that the power supply voltage control circuit 70 receives the voltage signal VHV1 and outputs a voltage signal VHVab corresponding to one of the voltage signals VHVa and VHVb. Further, the description will be made on the assumption that the fuse F receives the voltage signal VHVab and outputs the voltage signal VHV2. Likewise, description will be made on the assumption that the VBS supply control circuit 80 receives the reference voltage signal VBS1 and outputs the reference voltage signal VBS2 corresponding to either of the reference voltage signals VBS2-1 and VBS2-2. Further, description will be made on the assumption that the drive control circuit 51 receives a drive data signal DATA corresponding to either of the drive data signals DATA1 to DATA4 and outputs a VHV control signal VHV_CNT corresponding to either of the VHV control signals VHV_CNT1 to VHV_CNT4, a VBS control signal VBS_CNT corresponding to either of the VBS control signals VBS_CNT1 to VBS_CNT4, an abnormality signal ERR corresponding to either of the abnormality signals ERR1 to ERR4, a state signal BUSY corresponding to either of the state signals BUSY1 to BUSY4, and a drive signal COM corresponding to either of the drive signals COM1 to COM4. Description will be made on the assumption that the drive signal selection control circuit 200 receives the voltage signal VHV2 and the drive signal COM which are described above, and the clock signal SCK, the printing data signal SI corresponding to either of the printing data signals SI1 to SI4, the latch signal LAT, and the change signal CH which are output from the control signal output circuit 100, and outputs a drive signal VOUT corresponding to either of the drive signals VOUT1 to VOUT4, and the head 22 receives the drive signal VOUT and the reference voltage signal VBS.

3. Configuration of Ejecting Section

Figure 4:
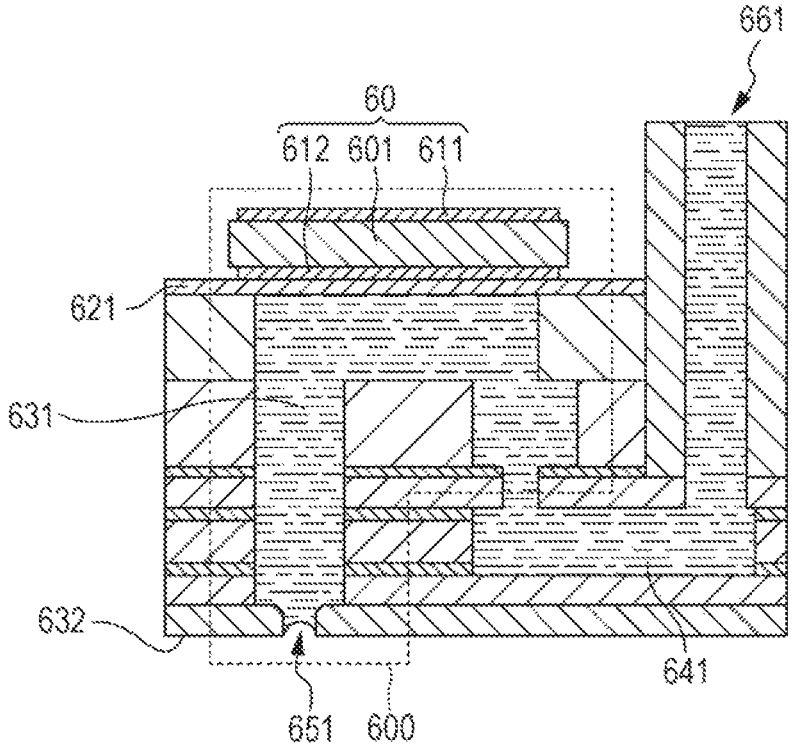
FIG. 4 is a cross-sectional view illustrating a schematic configuration of one ejecting section.

Here, a configuration of the ejecting section 600 included in each of the heads 22-1 to 22-4 will be described with reference to FIG. 4. FIG. 4 is a cross-sectional view illustrating a schematic configuration of one ejecting section 600.

FIG. 4 is a view illustrating a schematic configuration of one of the plurality of ejecting sections 600. As illustrated in FIG. 4, the ejecting section 600 includes the piezoelectric element 60, a vibration plate 621, a cavity 631, and a nozzle 651.

The cavity 631 is filled with ink supplied from a reservoir 641. Further, Ink is introduced into the reservoir 641 from an ink cartridge (not illustrated) via a supply hole 661. That is, the cavity 631 is filled with the ink stored in the corresponding ink cartridge.

The vibration plate 621 is displaced by driving the piezoelectric element 60 provided on an upper surface in FIG. 4. As the vibration plate 621 is displaced, an internal volume of the cavity 631 filled with ink is increased or reduced. That is, the vibration plate 621 functions as a diaphragm that changes the internal volume of the cavity 631.

The nozzle 651 is an opening which is provided in a nozzle plate 632 and communicates with the cavity 631. As the internal volume of the cavity 631 changes, ink of an amount corresponding to the change of the internal volume is ejected from the nozzle 651.

The piezoelectric element 60 has a structure in which a piezoelectric body 601 is interposed between a pair of electrodes 611 and electrodes 612. In the piezoelectric body 601 having the structure, central portions of the electrodes 611 and 612 bend in the vertical direction together with the vibration plate 621 according to a potential difference between voltages supplied by the electrodes 611 and 612. Specifically, the drive signal VOUT is supplied to the electrode 611 of the piezoelectric element 60, and the corresponding reference voltage signal VBS2 is supplied to the electrode 612. If a voltage level of the drive signal VOUT supplied to the electrode 611 is increased, the corresponding piezoelectric element 60 bends upward, and if the voltage level of the drive signal VOUT supplied to the electrode 611 is decreased, the corresponding piezoelectric element 60 bends downward.

In the ejecting section 600 configured as described above, as the piezoelectric element 60 bends upward, the vibration plate 621 is displaced and the internal volume of the cavity 631 is increased. As a result, ink is drawn in from the reservoir 641. Meanwhile, as the piezoelectric element 60 bends downward, the vibration plate 621 is displaced and the internal volume of the cavity 631 is reduced. As a result, the amount of ink corresponding to the degree of reduction is ejected from the nozzle 651.

The piezoelectric element 60 is not limited to the structure illustrated in FIG. 4, and the ejecting section 600 may have any structure as long as ink can be ejected as the piezoelectric element 60 is driven. Thus, the piezoelectric element 60 is not limited to the configuration of a bending vibration described above and may have, for example, a configuration of using a longitudinal vibration.

Here, the electrode 611 included in each of the plurality of piezoelectric elements 60 included in the head 22-1 is an example of a first terminal, and the electrode 612 is an example of a second terminal. Further, the electrode 611 included in each of the plurality of piezoelectric elements 60 included in the head 22-2 is an example of a third terminal, and the electrode 612 is an example of a fourth terminal. Further, the electrode 611 included in each of the plurality of piezoelectric elements 60 included in the head 22-3 is an example of a fifth terminal, and the electrode 612 is an example of a sixth terminal. Further, the electrode 611 included in each of the plurality of piezoelectric elements included in the head 22-4 is an example of a seventh terminal, and the electrode 612 is an example of an eighth terminal.

4. Configuration and Operation of Print Head

Next, a configuration and an operation of the ejecting module 21 included in the head unit 20 will be described.

In describing the configuration and operation of the ejecting module 21, an example of a waveform of the drive signal COM input to the ejecting module 21 will be first described with reference to FIG. 5. After that, a configuration and an operation of the drive signal selection control circuit 200 included in the ejecting module 21 will be described with reference to FIGS. 6 to 9.

Figure 5:
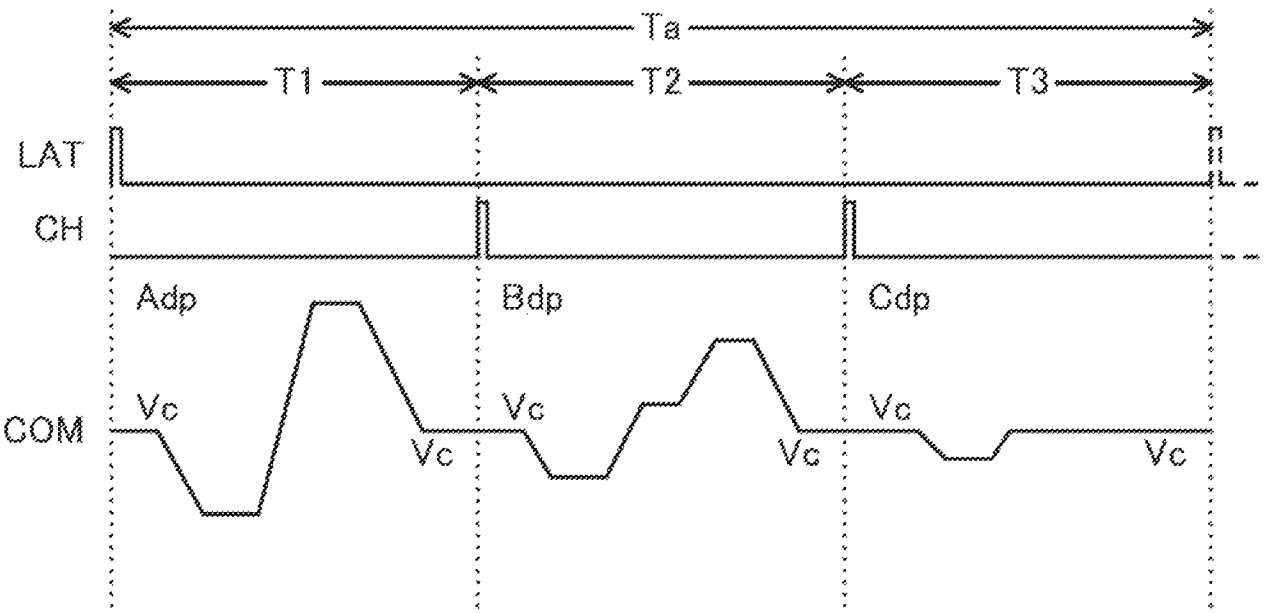
FIG. 5 is a diagram illustrating an example of a waveform of a drive signal COM.

FIG. 5 is a diagram illustrating an example of the waveform of the drive signal COM. FIG. 5 illustrates a period T1 from a rise of the latch signal LAT to a rise of the change signal CH, a period T2 from the period T1 to a next rise of the change signal CH, and a period T3 from the period T2 to a rise of the latch signal LAT. A period Ta configured by the periods T1, T2, and T3 corresponds to a printing cycle for forming new dots on the medium P. That is, as illustrated in FIG. 5, the latch signal LAT defines a printing cycle in which a new dot is formed on the medium P, and the change signal CH defines a switch timing of a waveform included in the drive signal COM.

As illustrated in FIG. 5, the drive signal COM includes a trapezoidal waveform Adp in the period T1. When the trapezoidal waveform Adp is supplied to the piezoelectric element 60, a predetermined amount, specifically, a medium amount of ink is ejected from the corresponding ejecting section 600. Further, the drive signal COM includes a trapezoidal waveform Bdp in the period T2. When the trapezoidal waveform Bdp is supplied to the piezoelectric element 60, a small amount of ink less than the predetermined amount is ejected from the corresponding ejecting section 600. Further, the drive signal COM includes a trapezoidal waveform Cdp in the period T3. When the trapezoidal waveform Cdp is supplied to the piezoelectric element 60, the piezoelectric element 60 is driven to such an extent that ink is not ejected from the corresponding ejecting section 600. Thus, when the trapezoidal waveform Cdp is supplied to the piezoelectric element 60, no dot is formed on the medium P. The trapezoidal waveform Cdp performs micro-vibration of ink near a nozzle opening of the ejecting section 600 to prevent viscosity of the ink from increasing. In the following description, driving the piezoelectric element 60 to such an extent that the ink is not ejected from the ejecting section 600 in order to prevent the viscosity of the ink from increasing is referred to as "micro vibration".

Here, a voltage value at a start timing and a voltage value at an end timing of each of the trapezoidal waveform Adp, the trapezoidal waveform Bdp, and the trapezoidal waveform Cdp are common as the voltage Vc. That is, the trapezoidal waveforms Adp, Bdp, and Cdp are waveforms whose voltage values start at the voltage Vc and end at the voltage Vc. As described above, the drive circuit 50 outputs the drive signal COM having a waveform in which the trapezoidal waveforms Adp, Bdp, and Cdp are continuous in the period Ta. The waveform of the drive signal COM illustrated in FIG. 5 is an example, and the present disclosure is not limited to this. Further, the drive signals COM1 to COM4 may have different waveforms from each other.

Figure 6:
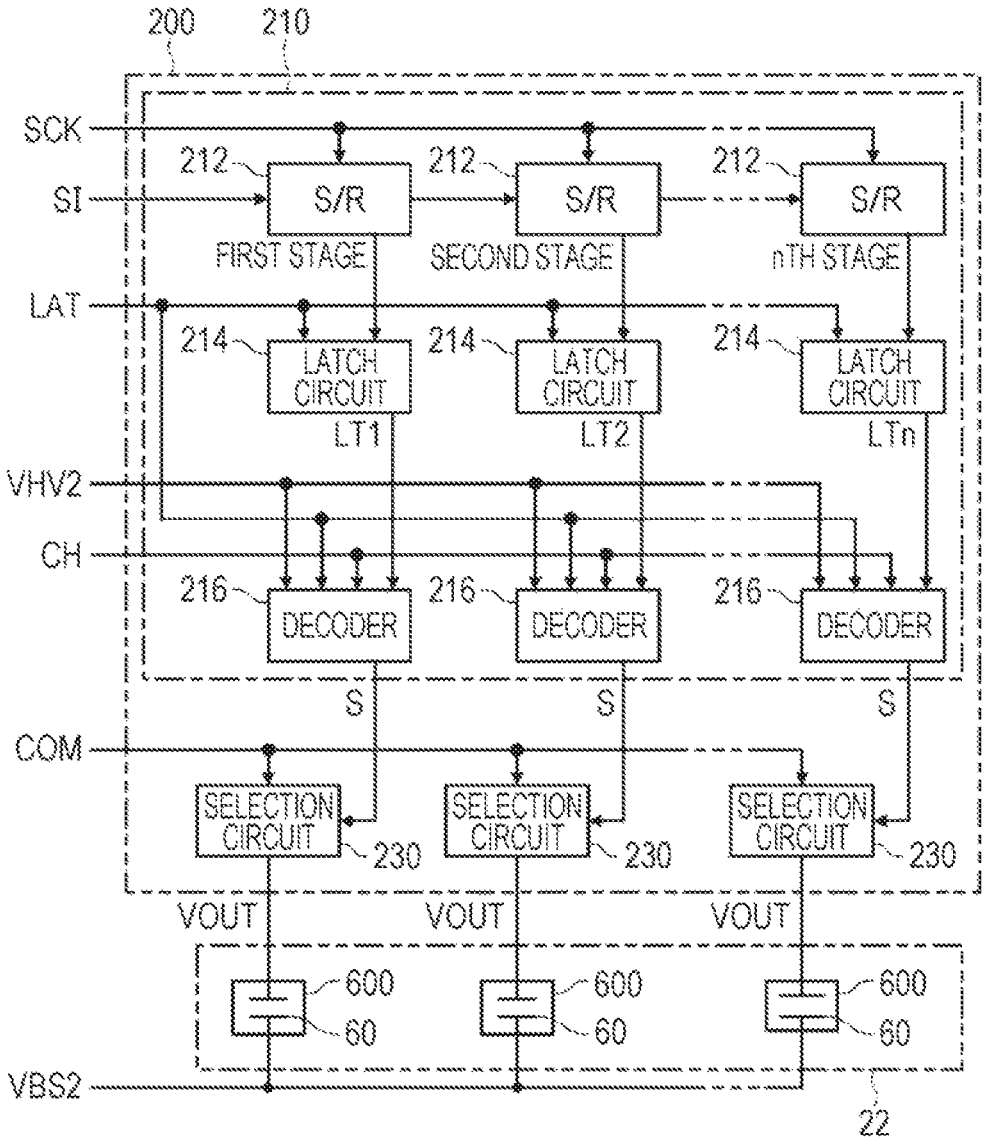
FIG. 6 is a diagram illustrating an electrical configuration of a drive signal selection control circuit.

FIG. 6 is a diagram illustrating an electrical configuration of the drive signal selection control circuit 200. The drive signal selection control circuit 200 switches whether or not to select the trapezoidal waveforms Adp, Bdp, and Cdp included in the drive signal COM in each of the periods T1, T2, and T3, thereby, outputting the drive signal VOUT to be supplied to the piezoelectric element 60 in the period Ta. As illustrated in FIG. 6, the drive signal selection control circuit 200 includes a selection control circuit 210 and a plurality of selection circuits 230.

The selection control circuit 210 is supplied with the clock signal SCK, the printing data signal SI, the latch signal LAT, the change signal CH, and the voltage signal VHV2. In the selection control circuit 210, a set of a shift register 212 (S/R), a latch circuit 214, and a decoder 216 is provided to correspond to each of the ejecting sections 600. That is, the ejecting module 21 is provided with the same number of sets of the shift register 212, the latch circuit 214, and the decoder 216 as a total number n of the ejecting sections 600.

The shift register 212 temporarily holds the 2-bit printing data [SIH, SIL] included in the printing data signal SI for each corresponding ejecting section 600. Specifically, the shift registers 212 of multiple stages corresponding to the ejecting sections 600 are cascade-coupled to each other, and the printing data signal SI supplied in serial is sequentially transferred to the subsequent stage according to the clock signal SCK. In FIG. 6, in order to distinguish between the shift registers 212, a first stage, a second stage, . . . , and an nth stage are described in order from an upstream to which the printing data signal SI is supplied.

Each of the n latch circuits 214 latches the printing data [SIH, SIL] held by the corresponding shift register 212 at a rising edge of the latch signal LAT. Each of the n decoders 216 decodes the 2-bit printing data [SIH, SIL] latched by the corresponding latch circuit 214, generates the selection signal S, and supplies the selection signal S to the selection circuit 230.

The selection circuits 230 are provided to correspond to the respective ejecting sections 600. That is, the number of selection circuits 230 included in one ejecting module 21 is n, which is the same as the total number of the ejecting sections 600 included in the ejecting module 21. The selection circuit 230 controls supply of the drive signal COM to the piezoelectric element 60 based on the selection signal S supplied from the decoder 216.

Figures 7, 8:
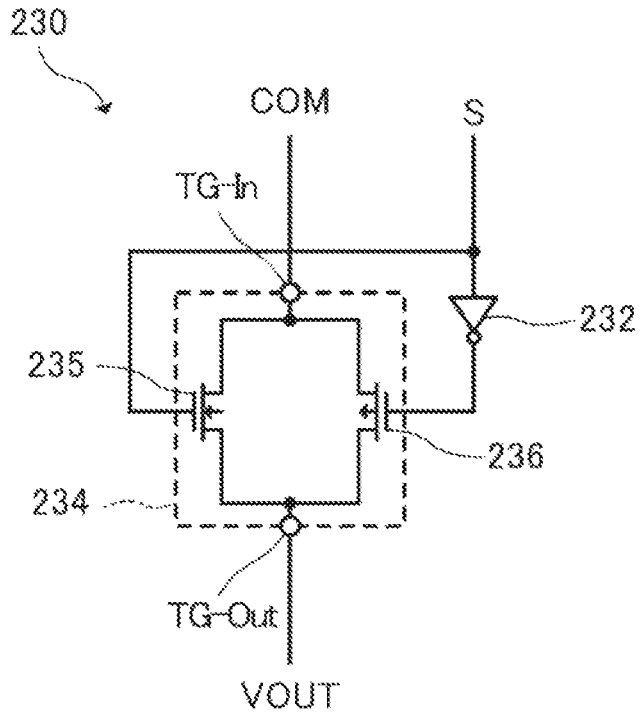
FIG. 7 is a diagram illustrating an electrical configuration of a selection circuit corresponding to one ejecting section.
FIG. 8 is a diagram illustrating decoding content in a decoder.

FIG. 7 is a diagram illustrating an electrical configuration of the selection circuit 230 corresponding to one ejecting section 600. As illustrated in FIG. 7, the selection circuit 230 includes an inverter 232 and a transfer gate 234. Further, the transfer gate 234 includes a transistor 235 that is an NMOS transistor and a transistor 236 that is a PMOS transistor.

The selection signal S is supplied from the decoder 216 to a gate terminal of the transistor 235. The selection signal S is logically inverted by the inverter 232 and is also supplied to a gate terminal of the transistor 236. A drain terminal of the transistor 235 and a source terminal of the transistor 236 are coupled to a terminal TG-In which is one end of the transfer gate 234. The drive signal COM is input to the terminal TG-In of the transfer gate 234. As the transistors 235 and 236 are turned on or off according to the selection signal S, the drive signal VOUT is output from a terminal TG-Out which is the other end of the transfer gate 234 to which a source terminal of the transistor 235 and a drain terminal of the transistor 236 are commonly coupled. The terminal TG-Out of the transfer gate 234 from which the drive signal VOUT is output is electrically coupled to an electrode 611, which will be described below, of the piezoelectric element 60.

Next, the decoding content of the decoder 216 will be described with reference to FIG. 8 FIG. 8 is a diagram illustrating the decoding content in the decoder 216. The decoder 216 receives the 2-bit printing data [SIH, SIL], the latch signal LAT, and the change signal CH. For example, when the printing data [SIH, SIL] is [1, 0] defining a "medium dot", the decoder 216 outputs the selection signal S having H, L, and L levels in the periods T1, T2, and T3. Here, the logic level of the selection signal S is level-shifted to a high amplitude logic based on the voltage signal VHV2 by a level shifter (not illustrated).

Figure 9:
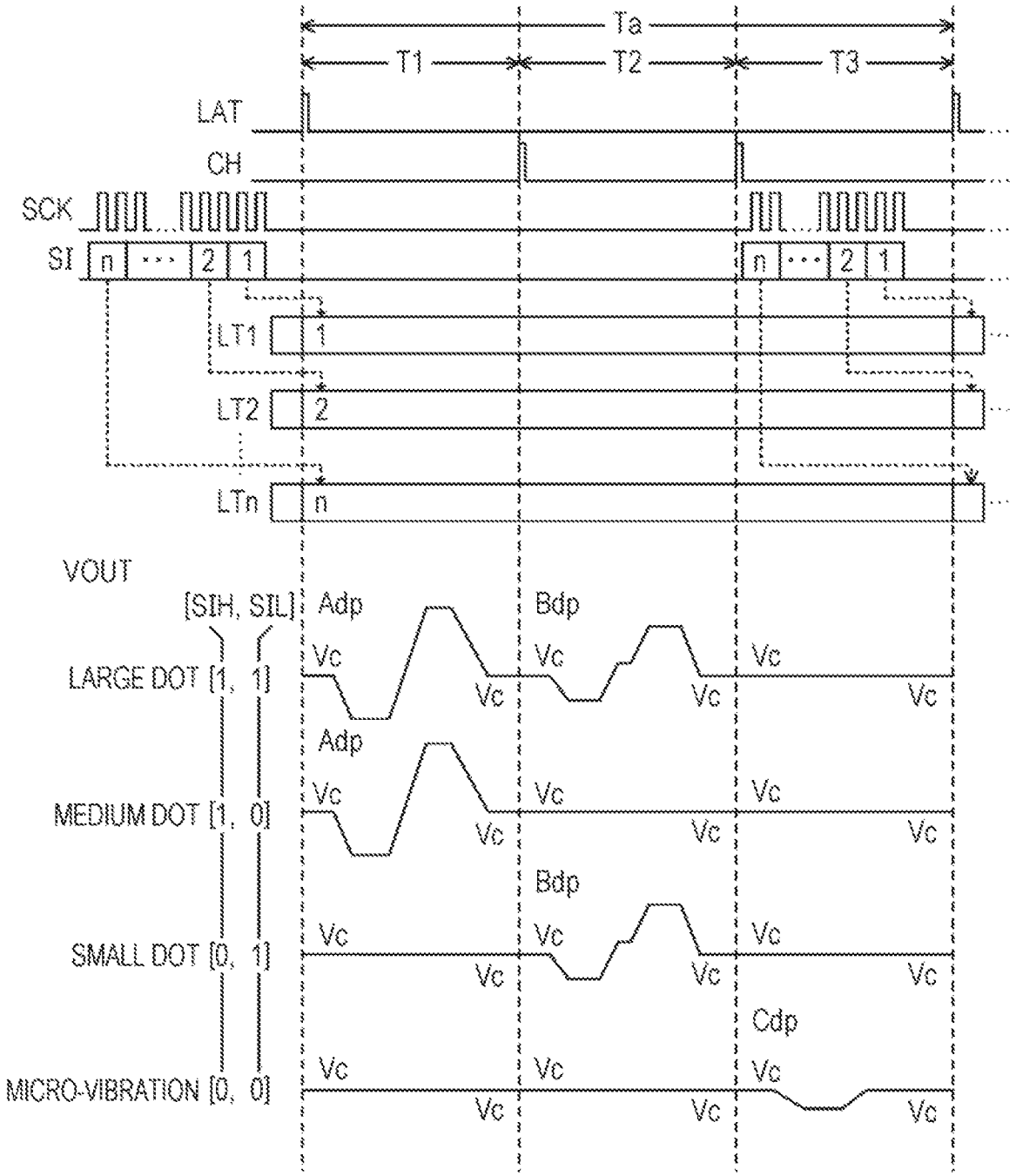
FIG. 9 is a diagram illustrating an operation of the drive signal selection control circuit.

FIG. 9 is a diagram illustrating an operation of the drive signal selection control circuit 200. As illustrated in FIG. 9, the printing data [SIH, SIL] included in the printing data signal SI are serially supplied to the drive signal selection control circuit 200 in synchronization with the clock signal SCK, and are sequentially transferred the shift register 212 corresponding to the ejecting section 600. When supply of the clock signal SCK is stopped, the printing data [SIH, SIL] corresponding to the ejecting section 600 is held in each of the shift registers 212. The printing data signal SI is supplied in the order corresponding to a last nth stage ejecting section 600, . . . , a second stage ejecting section 600, and a first stage ejecting section 600 in the shift register 212.

If the latch signal LAT rises, each of the latch circuits 214 simultaneously latches the printing data [SIH, SIL] held in the corresponding shift register 212. LT1, LT2, . . . , LTn illustrated in FIG. 9 indicate the printing data [SIH, SIL] latched by the latch circuits 214 corresponding to the first stage shift registers 212, the second stage shift registers 212, . . . , the nth stage shift registers 212.

The decoder 216 outputs the selection signal S having a logic level according to the contents illustrated in FIG. 8 in each of the periods T1, T2, and T3 according to the dots size defined by the latched printing data [SIH, SIL].

When the printing data [SIH, SIL] is [1, 1], the selection circuit 230 selects the trapezoidal waveform Adp in the period T1, selects the trapezoidal waveform Bdp in the period T2, and does not select the trapezoidal waveform Cdp in the period T3, according to the selection signal S. As a result, the drive signal VOUT corresponding to the large dot illustrated in FIG. 9 is generated. Thus, the ejecting section 600 ejects a medium amount of ink and a small amount of ink. The large dot is formed on the medium P by combining ink on the medium P. Further, when the printing data [SIH, SIL] is [1, 0], the selection circuit 230 selects the trapezoidal waveform Adp in the period T1, does not select the trapezoidal waveform Bdp in the period T2, and does not select the trapezoidal waveform Cdp in the period T3, according to the selection signal S. As a result, the drive signal VOUT corresponding to a medium dot illustrated in FIG. 9 is generated. Thus, the ejecting section 600 ejects a medium amount of ink. Thus, the medium dot is formed on the medium P. Further, when the printing data [SIH, SIL] is [0, 1], the selection circuit 230 does not select the trapezoidal waveform Adp in the period T1, selects the trapezoidal waveform Bdp in the period T2, and does not select the trapezoidal waveform Cdp in the period T3, according to the selection signal S. As a result, the drive signal VOUT corresponding to the small dot illustrated in FIG. 9 is generated. Thus, a small amount of ink is ejected from the ejecting section 600. Thus, the small dot is formed on the medium P. When the printing data [SIH, SIL] is [0, 0], the selection circuit 230 does not select the trapezoidal waveform Adp in the period T1, does not select the trapezoidal waveform Bdp in the period T2, and select the trapezoidal waveform Cdp in the period T3, according to the selection signal S. As a result, the drive signal VOUT corresponding to the micro-vibration illustrated in FIG. 9 is generated. Thus, ink is not ejected from the ejecting section 600, and the micro-vibration is generated.

5. Configuration and Operation of Drive Circuit

Next, a configuration and an operation of the drive circuit 50 will be described. As illustrated in FIG. 3A, the drive circuit 50 includes the power supply voltage control circuits 70-1 and 70-2, the VBS supply control circuits 80-1 and 80-2, the reference voltage signal output circuit 30, the drive control circuits 51-1 to 51-4, and the fuses F1 and F2.

5.1. Configuration and Operation of Power Supply Voltage Control Circuit

Figure 10:
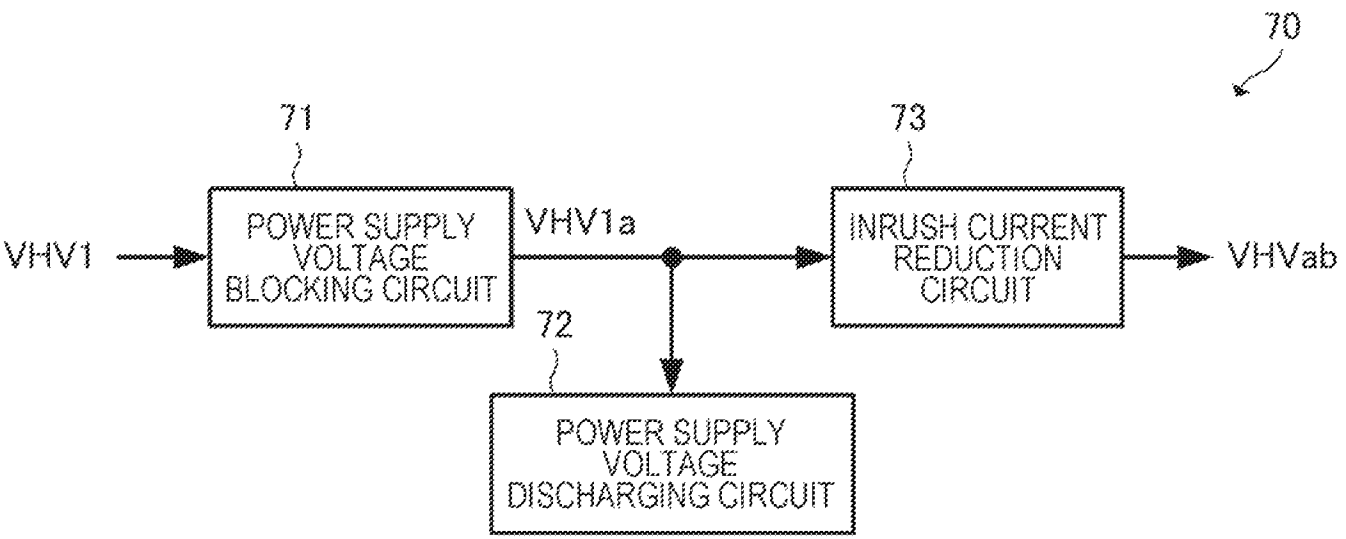
FIG. 10 is a diagram illustrating a configuration of a power supply voltage control circuit.

FIG. 10 is a diagram illustrating the configuration of the power supply voltage control circuit 70. As illustrated in FIG. 10, the power supply voltage control circuit 70 includes a power supply voltage blocking circuit 71, a power supply voltage discharging circuit 72, and an inrush current reduction circuit 73. The voltage signal VHV1 input to the power supply voltage control circuit 70 is input to the power supply voltage blocking circuit 71. The power supply voltage blocking circuit 71 controls whether or not to supply the input voltage signal VHV1 to the inrush current reduction circuit 73 as a voltage signal VHV1*a*. The inrush current reduction circuit 73 reduces an inrush current generated when supply of the voltage signal VHV1*a* is started, in a state where the supply of the voltage signal VHV1*a* is blocked by the power supply voltage blocking circuit 71. In other words, the inrush current reduction circuit 73 reduces a possibility of generating an inrush current of a large current based on the voltage signal VHV1*a* output from the power supply voltage control circuit 70. The power supply voltage discharging circuit 72 is electrically coupled to the power supply voltage blocking circuit 71 and the inrush current reduction circuit 73 and is electrically coupled to a wire through which the voltage signal VHV1*a* propagates. The power supply voltage discharging circuit 72 controls release of electric charges stored in a path to which the voltage signal VHV1*a* output from the power supply voltage blocking circuit 71 is supplied.

Figure 11:
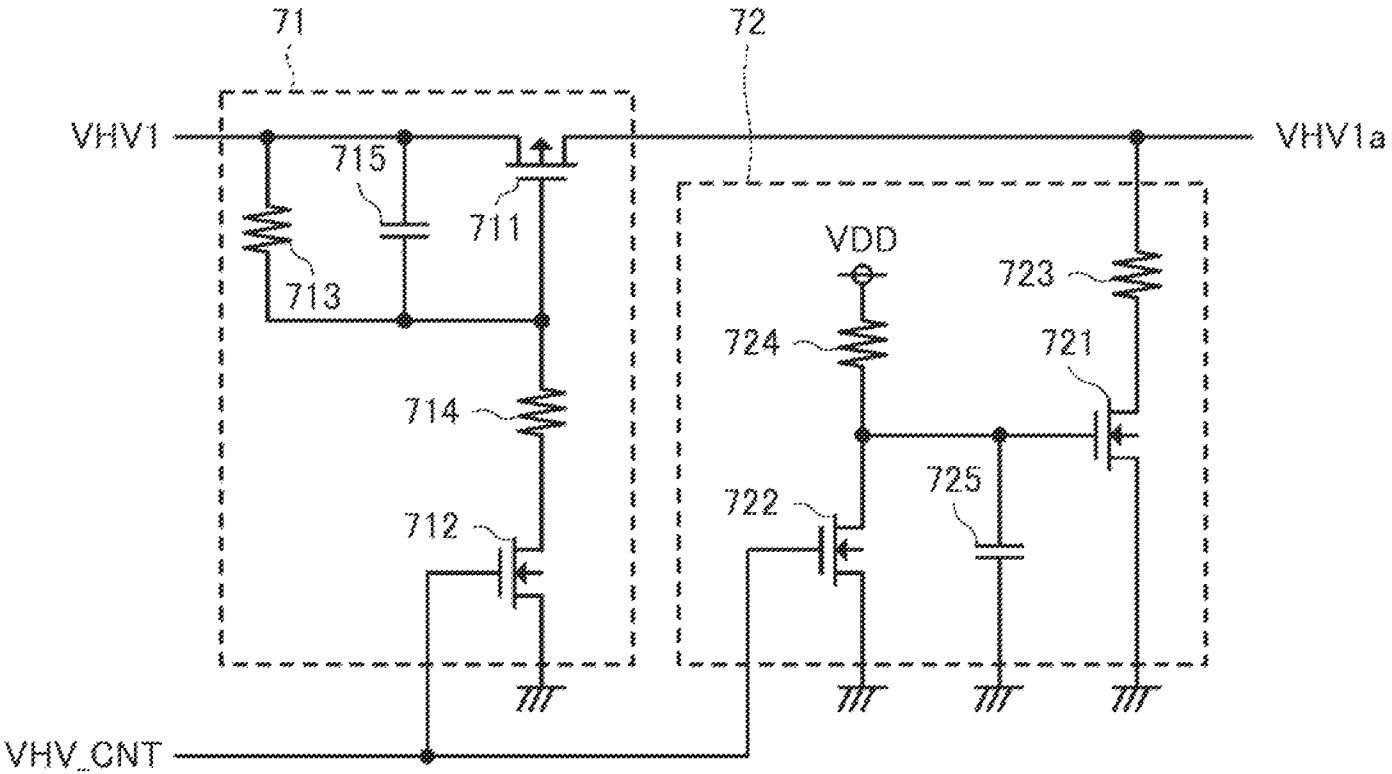
FIG. 11 is a diagram illustrating an example of configurations of a power supply voltage blocking circuit and a power supply voltage discharging circuit.

Specific examples of configurations of the power supply voltage blocking circuit 71, the power supply voltage discharging circuit 72, and the inrush current reduction circuit 73 included in the power supply voltage control circuit 70 will be described with reference to FIGS. 11 and 12. FIG. 11 is a diagram illustrating the example of the configuration of the power supply voltage blocking circuit 71 and the power supply voltage discharging circuit 72. As illustrated in FIG. 11, the power supply voltage blocking circuit 71 includes transistors 711 and 712, resistors 713 and 714, and a capacitor 715. Here, description will be made on the assumption that the transistor 711 is a PMOS transistor and the transistor 712 is an NMOS transistor.

The voltage signal VHV1 is input to a source terminal of the transistor 711. As conduction between a source terminal and a drain terminal of the transistor 711 is enabled, the voltage signal VHV1 is output from the drain terminal of the transistor 711 as the voltage signal VHV1*a*. In other words, the power supply voltage control circuit 70 switches conduction or non-conduction between the source terminal and the drain terminal of the transistor 711, thereby, switching whether or not to output the voltage signal VHV1 as the voltage signal VHV1*a*. A gate terminal of the transistor 711 is electrically coupled to one end of the resistor 713, one end of the resistor 714, and one end of the capacitor 715.

The voltage signal VHV1 is input to the other end of the resistor 713 and the other end of the capacitor 715. That is, the resistor 713 and the capacitor 715 are provided in parallel with the transistor 711 between the source terminal and the gate terminal of the transistor 711. The other end of the resistor 714 is electrically coupled to a drain terminal of the transistor 712. A ground potential is supplied to a source terminal of the transistor 712. Further, the VHV control signal VHV_CNT is input from the drive control circuit 51 to a gate terminal of the transistor 712.

When an VHV control signal VHV_CNT of an H level is input to the power supply voltage blocking circuit 71 configured as described above, the transistor 712 is turned on. As the transistor 712 is turned on, the transistor 711 is turned on. As a result, conduction between the source terminal and the drain terminal of the transistor 711 is enabled. Thus, the voltage signal VHV1 is output as the voltage signal VHV1*a*. Meanwhile, when the VHV control signal VHV_CNT of an L level is input to the power supply voltage blocking circuit 71, the transistor 712 is turned off. When the transistor 712 is turned off, the transistor 711 is turned off. As a result, conduction between the source terminal and the drain terminal of the transistor 711 is disabled. Thus, the voltage signal VHV1 is not output as the voltage signal VHV1*a*. As described above, the power supply voltage blocking circuit 71 switches whether or not to output the voltage signal VHV1 as the voltage signal VHV1*a* based on a logic level of the VHV control signal VHV_CNT.

The power supply voltage discharging circuit 72 includes transistors 721 and 722, resistors 723 and 724, and a capacitor 725. Here, description will be made on the assumption that both the transistors 721 and 722 are NMOS transistors.

One end of the resistor 723 is electrically coupled to a wire through which the voltage signal VHV1*a* is propagated, and the other end of the resistor 723 is electrically coupled to a drain terminal of the transistor 721. The ground potential is supplied to a source terminal of the transistor 721. A gate terminal of the transistor 721 is electrically coupled to one end of the resistor 724, one end of the capacitor 725, and a drain terminal of the transistor 722. The other end of the resistor 724 is supplied to the voltage signal VDD. The ground potential is supplied to the other end of the capacitor 725 and a source terminal of the transistor 722. The VHV control signal VHV_CNT is input to a gate terminal of the transistor 722.

The power supply voltage discharging circuit 72 configured as described above is electrically coupled to a wire that electrically couples the power supply voltage blocking circuit 71 to the inrush current reduction circuit 73. The power supply voltage discharging circuit 72 controls release of stored electric charges based on the voltage signal VHV1*a* according to a logic level of the VHV control signal VHV_CNT. Specifically, when the VHV control signal VHV_CNT of an H level is input to the power supply voltage discharging circuit 72, the transistor 722 is turned on. As the transistor 722 is turned on, the transistor 721 is turned off. Thus, a path through which the voltage signal VHV1*a* is propagated and a path through which the ground potential is supplied are controlled to be non-conductive by the transistor 721. As a result, the power supply voltage discharging circuit 72 does not release electric charges based on the voltage signal VHV1*a*. Meanwhile, when the VHV control signal VHV_CNT of an L level is input to the power supply voltage discharging circuit 72, the transistor 722 is turned off. As the transistor 722 is turned off, the voltage signal VDD is supplied to the gate terminal of the transistor 721. Thus, the transistor 721 is turned on. Thereby, the path through which the voltage signal VHV1*a* is propagated and the path through which the ground potential is supplied are electrically coupled to each other via the resistor 723. Thereby, the power supply voltage discharging circuit 72 releases the electric charge stored in the path through which the voltage signal VHV1*a* is propagated.

As described above, the power supply voltage blocking circuit 71 and the power supply voltage discharging circuit 72 switches whether to output the voltage signal VHV1 to the inrush current reduction circuit 73 as the voltage signal VHV1*a* based on the logic level of the VHV control signal VHV_CNT or to release the electric charges stored in the path through which the voltage signal VHV1*a* is propagated.

Figure 12:
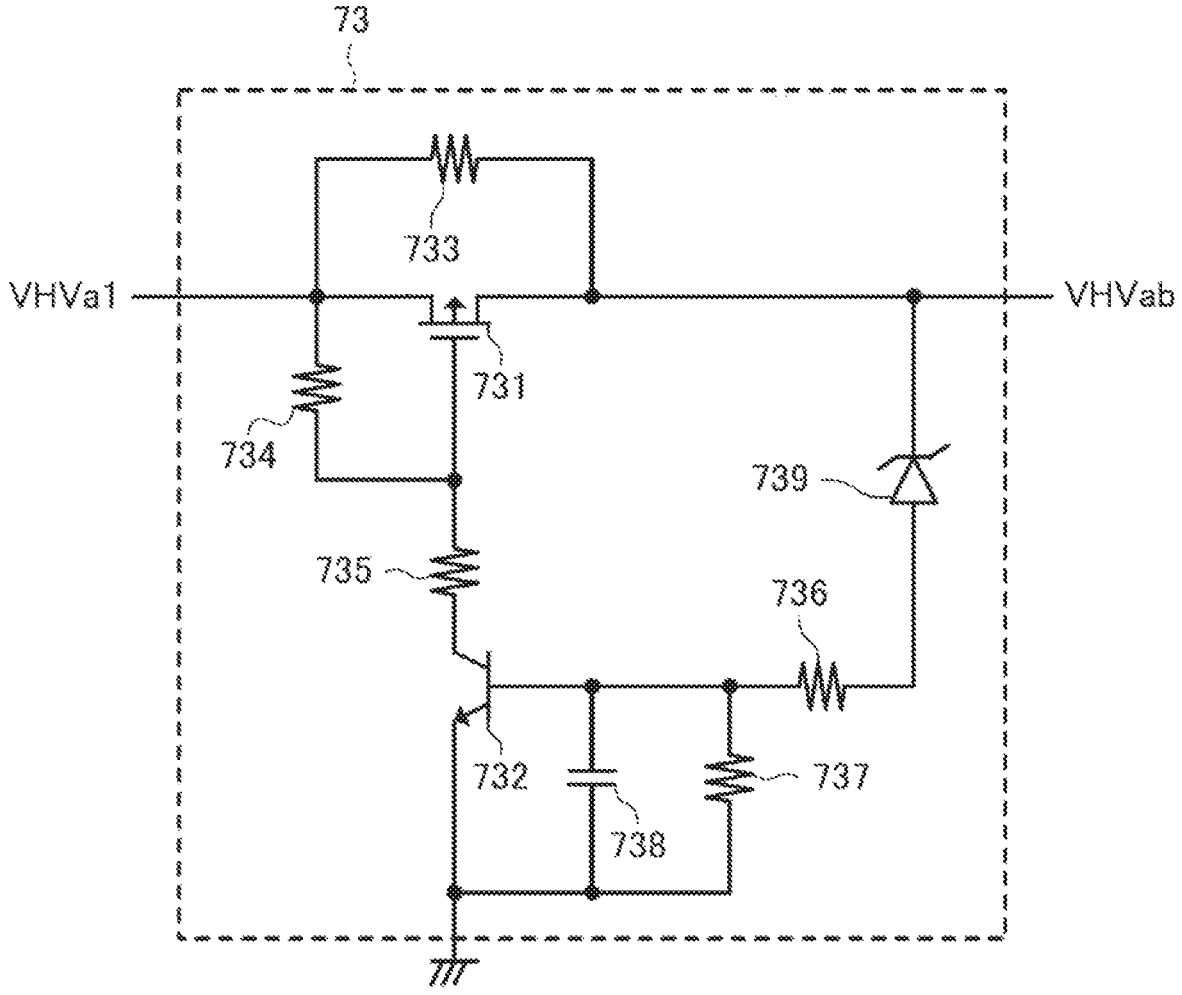
FIG. 12 is a diagram illustrating a configuration of an inrush current reduction circuit.

FIG. 12 is a diagram illustrating a configuration of the inrush current reduction circuit 73. As illustrated in FIG. 12, the inrush current reduction circuit 73 includes transistors 731 and 732, resistors 733, 734, 735, 736, and 737, a capacitor 738, and a constant voltage diode 739. Here, description will be made on the assumption that the transistor 731 is a PMOS transistor and the transistor 732 is an N-type bipolar transistor.

The voltage signal VHV1*a* is input to a source terminal of the transistor 731. As a drain terminal and the source terminal of the transistor 731 are controlled to be conductive, the voltage signal VHV1*a* is output from the drain terminal of the transistor 731 as the voltage signal VHVa. A gate terminal of the transistor 731 is electrically coupled to one end of the resistor 734 and one end of the resistor 735. The voltage signal VHV1*a* is input to the other end of the resistor 734. That is, the resistor 734 is provided in parallel with the transistor 731 between the source terminal and the gate terminal of the transistor 731. The resistor 733 has one end electrically coupled to the source terminal of the transistor 731 and the other end electrically coupled to the drain terminal of the transistor 731.

The other end of the resistor 735 is electrically coupled to a collector terminal of the transistor 732. A ground potential is supplied to an emitter terminal of the transistor 732. A base terminal of the transistor 732 is electrically coupled to one end of the resistor 736, one end of the resistor 737, and one end of the capacitor 738. The ground potential is supplied to the other end of the resistor 737 and the other end of the capacitor 738. That is, the resistor 737 and the capacitor 738 are provided between the base terminal and the emitter terminal of the transistor 732 in parallel with the transistor 732.

The other end of the resistor 736 is electrically coupled to an anode terminal of the constant voltage diode 739. The voltage signal VHVa is input to a cathode terminal of the constant voltage diode 739.

The inrush current reduction circuit 73 configured as described above does not receive the voltage signal VHV1*a*, when supply of the voltage signal VHV1*a* is blocked by the power supply voltage blocking circuit 71. Thus, the inrush current reduction circuit 73 does not output the voltage signal VHVa. Since the voltage signal VHVa is not output, a potential of the anode terminal of the constant voltage diode 739 becomes the ground potential supplied through the resistor 737. Thus, the transistor 732 is turned off, and the transistor 731 is also turned off.

In a state where supply of the voltage signal VHV1*a* is blocked by the power supply voltage blocking circuit 71, when the supply of the voltage signal VHV1*a* is started, the voltage signal VHV1*a* is input to the inrush current reduction circuit 73. In this case, the transistor 731 is turned off, and thus, the voltage signal VHV1*a* is input to the drain terminal of the transistor 731 via the resistor 733 as the voltage signal VHVab. At this time, a current generated by the voltage signal VHV1*a* and the voltage signal VHVab is limited by the resistor 733. Thus, a possibility of generating an inrush current of a large current is reduced.

As a predetermined period elapses after input of the voltage signal VHV1*a* to the inrush current reduction circuit starts, a voltage value of the voltage signal VHVab increases. When the voltage value of the voltage signal VHVab is greater than or equal to a predetermined value defined by the constant voltage diode 739, a voltage value of the anode terminal of the constant voltage diode 739 increases. After that, When the voltage value of the anode terminal of the constant voltage diode 739 exceeds a threshold voltage of the transistor 732, the transistor 732 is turned on. If the transistor 732 is turned on, the transistor 731 is turned on. As a result, conduction between the drain terminal and the source terminal of the transistor 731 is enabled, and the voltage signal VHV1*a* is output from the power supply voltage control circuit 70 via the transistor 731 as the voltage signal VHVab.

In the inrush current reduction circuit 73 configured as described above, in a state where the supply of the voltage signal VHV1*a* is blocked, immediately after the supply of the voltage signal VHV1*a* is started, the voltage signal VHV1*a* is propagated to the drain terminal of the transistor 731 via the resistor 733. Thereby, it is possible to reduce a possibility that an inrush current of a large current is generated. Further, as a voltage value of voltage signal VHVab is greater than or equal to a predetermined value defined by the constant voltage diode 739, the transistor 731 is turned on. Thereby, it is possible to reduce a power loss generated by the resistor 733.

The voltage signal VHVab output from the power supply voltage control circuit 70 is input to the drive control circuit 51 and also input to the drive control circuit 51 via the fuse F1 as the voltage signal VHV2. Furthermore, the voltage signal VHV2 is output from the drive circuit 50 to the head unit 20.

5.2. Configuration and Operation of Reference Voltage Signal Output Circuit

Figure 13:
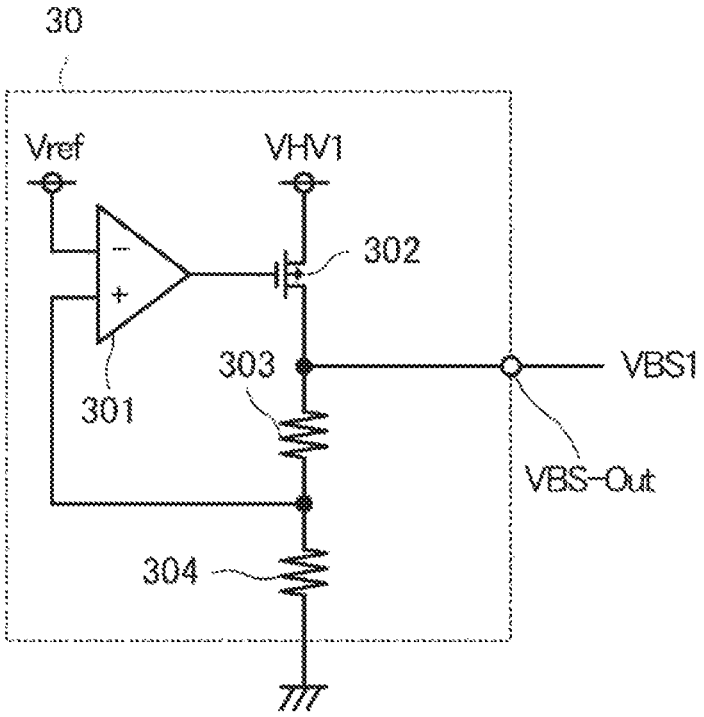
FIG. 13 is a diagram illustrating a configuration of a reference voltage signal output circuit.

Next, a configuration and an operation of the reference voltage signal output circuit 30 will be described. FIG. 13 is a diagram illustrating the configuration of the reference voltage signal output circuit 30. The reference voltage signal output circuit 30 includes a comparator 301, a transistor 302, and resistors 303 and 304. Description will be made on the assumption that the transistor 302 is a PMOS transistor.

A reference voltage Vref is supplied to a negative input end of the comparator 301. Further, a positive input end of the comparator 301 is electrically coupled to one end of the resistor 303 and one end of the resistor 304. An output end of the comparator 301 is electrically coupled to a gate terminal of the transistor 302. The voltage signal VHV1 is supplied to a source terminal of the transistor 302. A drain terminal of the transistor 302 is electrically coupled to the other end of the resistor 303 and a terminal VBS-Out from which the reference voltage signal VBS is output. The ground potential is supplied to the other end of the resistor 304.

In the reference voltage signal output circuit 30 configured as described above, when a voltage value supplied to the positive input end of the comparator 301 is greater than a voltage value of the reference voltage Vref supplied to the negative input end of the comparator 301, the comparator 301 outputs a signal of an H level. At this time, the transistor 302 is turned off. Thus, the voltage signal VHV1 is not supplied to the terminal VBS-Out. Meanwhile, when the voltage value supplied to the positive input end of the comparator 301 is less than the voltage value of the reference voltage Vref supplied to the negative input end of the comparator 301, the comparator 301 outputs a signal of an L level. At this time, the transistor 302 is turned on. Thus, the voltage signal VHV1 is supplied to a terminal VBS-Out. That is, as the comparator 301 operates such that a voltage value obtained by dividing the reference voltage signal VBS by the resistors 303 and 304 is equal to the voltage value of the reference voltage Vref, the reference voltage signal output circuit 30 generates a reference voltage signal VBS1 having a constant voltage value at a voltage Vbs based on the voltage signal VHV1 and outputs the reference voltage signal VBS1 from the terminal VBS-Out.

Here, the reference voltage signal output circuit 30 is an example of a reference voltage signal output circuit, and the reference voltage signal VBS1 output by the reference voltage signal output circuit 30 is an example of a reference voltage signal. The voltage Vbs, which is a voltage value of the reference voltage signal VBS1, is an example of a reference voltage value. The terminal VBS-Out from which the reference voltage signal VBS1 from the reference voltage signal output circuit 30 is output is an example of an output terminal of the reference voltage signal output circuit 30.

5.3. Configuration and Operation of VBS Supply Control Circuit

Figure 14:
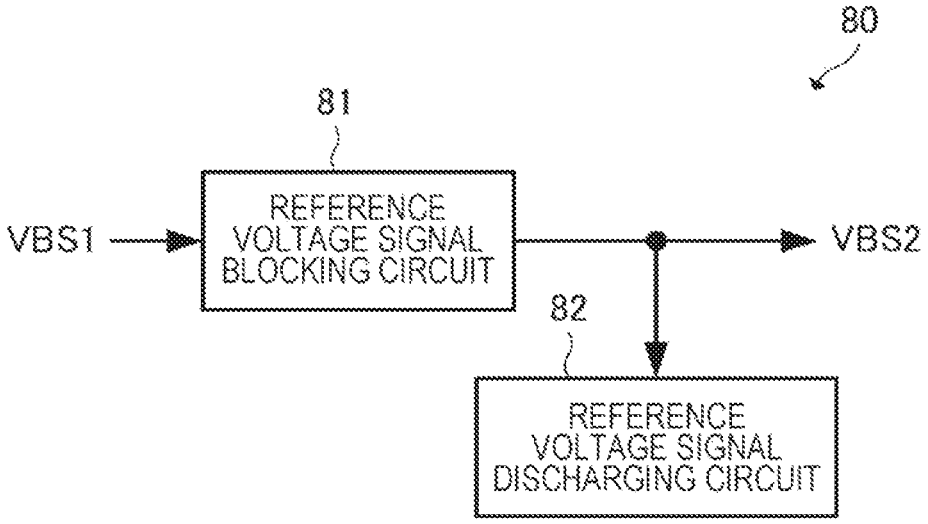
FIG. 14 is a diagram illustrating a configuration of a VBS supply control circuit.

Next, a configuration and an operation of the VBS supply control circuit 80 will be described. FIG. 14 is a diagram illustrating a configuration of the VBS supply control circuit 80. As illustrated in FIG. 14, the VBS supply control circuit 80 includes a reference voltage signal blocking circuit 81 and a reference voltage signal discharging circuit 82. The reference voltage signal VBS1 input to the VBS supply control circuit 80 is input to the reference voltage signal blocking circuit 81. The reference voltage signal blocking circuit 81 controls whether or not the input reference voltage signal VBS1 is output as the reference voltage signal VBS2. The reference voltage signal discharging circuit 82 is electrically coupled to an output end of the reference voltage signal blocking circuit 81. The reference voltage signal discharging circuit 82 controls discharging of electric charges stored in a path to which the reference voltage signal VBS2 output from the reference voltage signal blocking circuit 81 is supplied.

Figure 15:
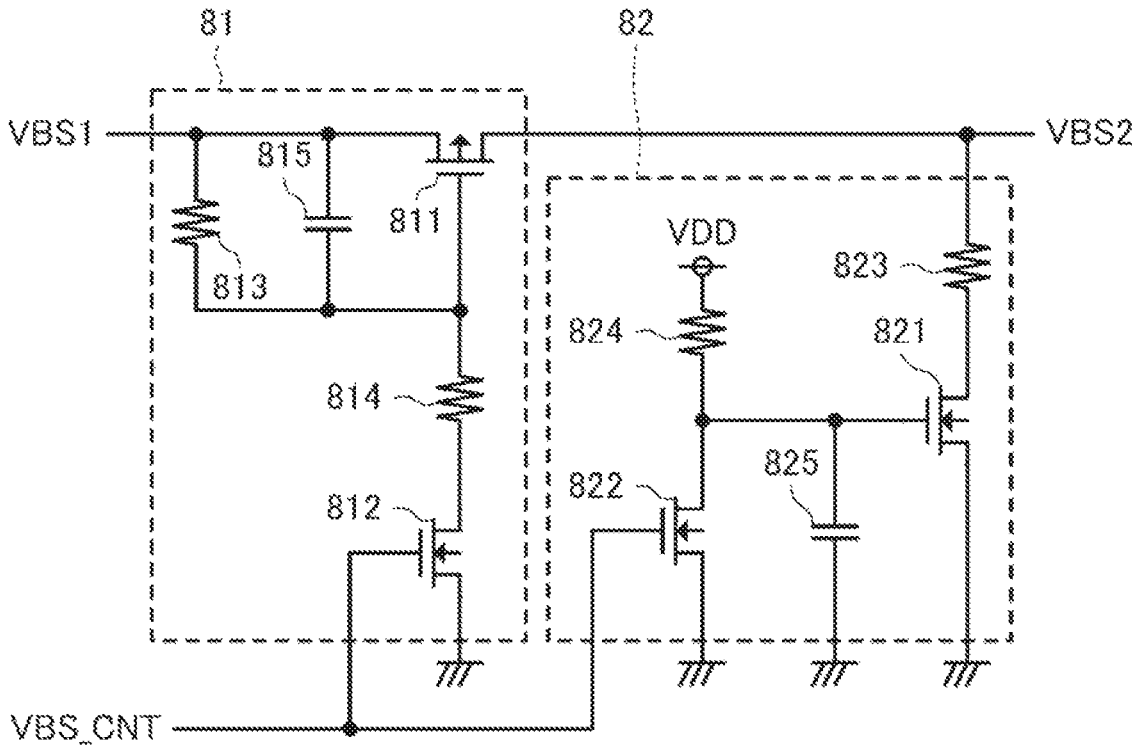
FIG. 15 is a diagram illustrating an example of configurations of a reference voltage signal blocking circuit and a reference voltage signal discharging circuit.

A specific example of configurations of the reference voltage signal blocking circuit 81 and the reference voltage signal discharging circuit 82 included in the VBS supply control circuit 80 will be described with reference to FIG. 15. FIG. 15 is a diagram illustrating an example of the configurations of the reference voltage signal blocking circuit 81 and the reference voltage signal discharging circuit 82. As illustrated in FIG. 15, the reference voltage signal blocking circuit 81 includes transistors 811 and 812, resistors 813 and 814, and a capacitor 815. Here, description will be made on the assumption that the transistor 811 is a PMOS transistor and the transistor 812 is an NMOS transistor.

The reference voltage signal VBS1 is input to a source terminal of the transistor 811. As conduction between the source terminal and a drain terminal of the transistor 811 is enabled, the reference voltage signal VBS1 is output from the drain terminal of the transistor 811 as the reference voltage signal VBS2. In other words, the VBS supply control circuit 80 switches conduction or non-conduction between the source terminal and the drain terminal of the transistor 811, thereby, switching whether or not to output the reference voltage signal VBS1 as the reference voltage signal VBS2. A gate terminal of the transistor 811 is electrically coupled to one end of the resistor 813, one end of the resistor 814, and one end of the capacitor 815.

The reference voltage signal VBS1 is input to the other end of the resistor 813 and the other end of the capacitor 815. That is, the resistor 813 and the capacitor 815 are provided in parallel with the transistor 811 between the source terminal and the gate terminal of the transistor 811. The other end of the resistor 814 is electrically coupled to the drain terminal of the transistor 812. The ground potential is supplied to the source terminal of the transistor 812. Further, the VBS control signal VBS_CNT is input from the drive control circuit 51 to a gate terminal of the transistor 812.

When the VBS control signal VBS_CNT of an H level is input to the reference voltage signal blocking circuit 81 configured as described above, the transistor 812 is turned on. By controlling the transistor 812 to be turned on, the transistor 811 is turned on. As a result, conduction is enabled between the source terminal and the drain terminal of the transistor 811. Thus, the reference voltage signal VBS1 is output as the reference voltage signal VBS2. Meanwhile, when the VBS control signal VBS_CNT of an L level is input to the reference voltage signal blocking circuit 81, the transistor 812 is turned off. Then, the transistor 812 is turned off, so that the transistor 811 is turned off. As a result, conduction between the source terminal and the drain terminal of the transistor 811 is disabled. Thus, the reference voltage signal VBS1 is not output as the reference voltage signal VBS2. As described above, the reference voltage signal blocking circuit 81 including the transistor 811 switches whether or not to output the reference voltage signal VBS1 as the reference voltage signal VBS2 based on a logic level of the VBS control signal VBS_CNT.

The reference voltage signal discharging circuit 82 includes transistors 821 and 822, resistors 823 and 824, and a capacitor 825. Here, description will be made on the assumption that the transistors 821 and 822 are both NMOS transistors.

One end of the resistor 823 is electrically coupled to a wire through which the reference voltage signal VBS2 is propagated, and the other end of the resistor 723 is electrically coupled to a drain terminal of the transistor 821. The ground potential is supplied to a source terminal of the transistor 821. The gate terminal of the transistor 821 is electrically coupled to one end of the resistor 824, one end of the capacitor 825, and a drain terminal of the transistor 822. The voltage signal VDD is supplied to the other end of the resistor 824. The ground potential is supplied to the other end of the capacitor 825 and a source terminal of the transistor 822. The VBS control signal VBS_CNT is input to a gate terminal of the transistor 822.

The reference voltage signal discharging circuit 82 configured as described above is electrically coupled to a wire through which the reference voltage signal VBS2 is output from the reference voltage signal blocking circuit 81. The reference voltage signal discharging circuit 82 controls discharging of the stored electric charges based on the reference voltage signal VBS2 according to a logic level of the VBS control signal VBS_CNT. Specifically, when the VBS control signal VBS_CNT of an H level is input to the reference voltage signal discharging circuit 82, the transistor 822 is turned on. As the transistor 822 is turned on, the transistor 821 is turned off. Thus, a path through which the reference voltage signal VBS2 is propagated and a path through which the ground potential is supplied are not conducted by the transistor 821. As a result, the reference voltage signal discharging circuit 82 does not discharge the electric charges based on the reference voltage signal VBS2. Meanwhile, when the VBS control signal VBS_CNT of an L level is input to the reference voltage signal discharging circuit 82, the transistor 822 is turned off. As the transistor 822 is turned off, the voltage signal VDD is supplied to the gate terminal of the transistor 821. Thus, the transistor 821 is turned on. As a result, the path through which the reference voltage signal VBS2 is propagated and the path through which the ground potential is supplied are electrically coupled to each other via the resistor 823. Thereby, the reference voltage signal discharging circuit 82 releases the electric charges stored in the path through which the reference voltage signal VBS2 is propagated.

As described above, the reference voltage signal blocking circuit 81 and the reference voltage signal discharging circuit 82 included in the VBS supply control circuit 80 switches where to output the reference voltage signal VBS1 as the reference voltage signal VBS2 based on a logic level of the VBS control signal VBS_CNT or to release the electric charges stored in the path through which the reference voltage signal VBS2 is propagated.

Here, among the VBS supply control circuits 80-1 and 80-2 illustrated in FIG. 3A, the VBS supply control circuit 80-1 is an example of a first switch circuit, and the VBS supply control circuit 80-2 is an example of a second switch circuit.

5.4. Configuration and Operation of Drive Signal Control Circuit

Figure 16:
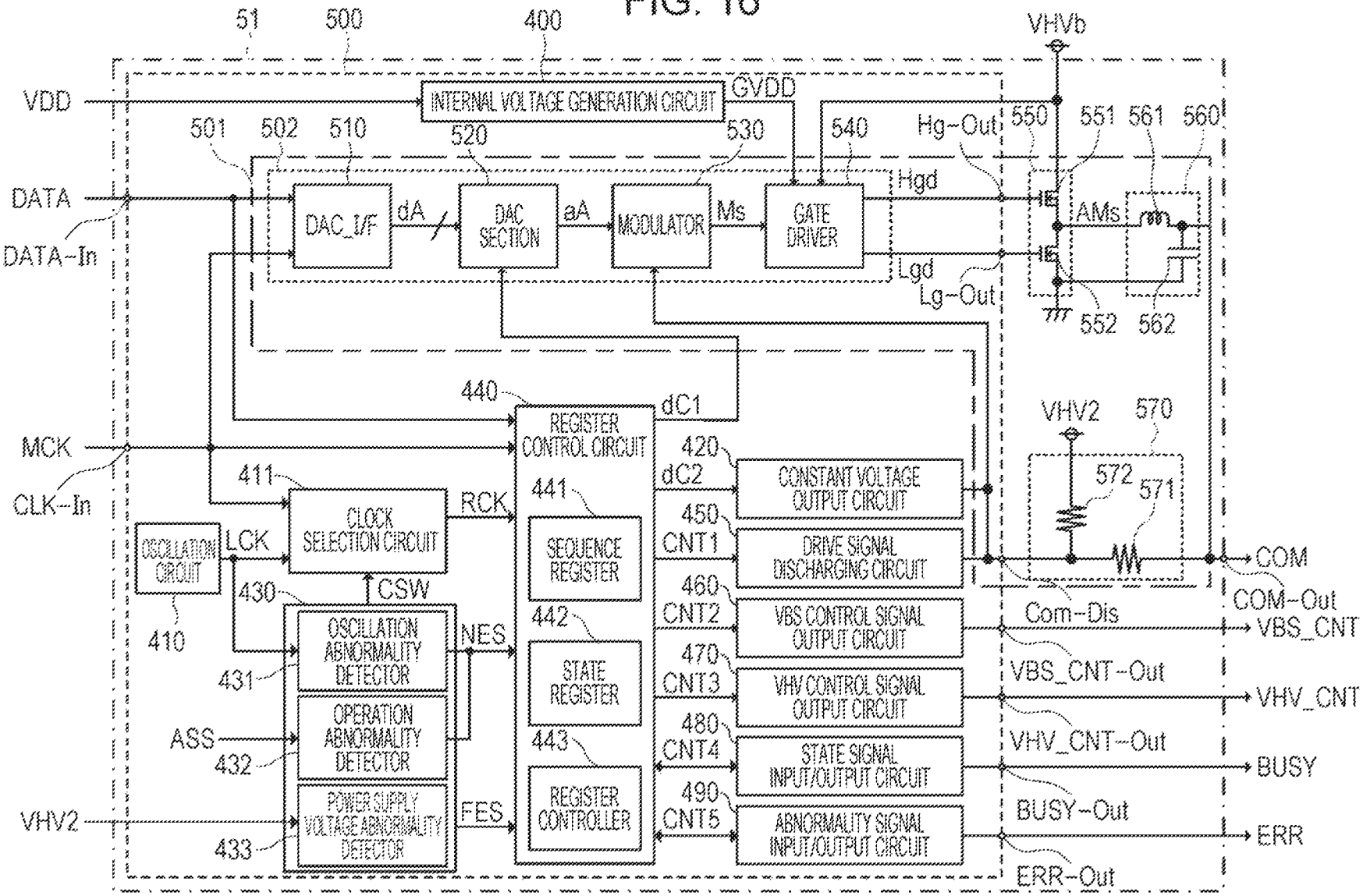
FIG. 16 is a diagram illustrating an example of a configuration of a drive control circuit.

Next, a configuration and an operation of the drive control circuit 51 will be described with reference to FIG. 16. FIG. 16 is a diagram illustrating an example of the configuration of the drive control circuit 51. The drive control circuit 51 includes an integrated circuit 500, an amplification circuit 550, a demodulation circuit 560, and a feedback circuit 570.

The integrated circuit 500 includes an amplification control signal generation circuit 502, an internal voltage generation circuit 400, an oscillation circuit 410, a clock selection circuit 411, an abnormality detection circuit 430, a register control circuit 440, a constant voltage output circuit 420, a drive signal discharging circuit 450, a VBS control signal output circuit 460, a VHV control signal output circuit 470, a state signal input/output circuit 480, and an abnormality signal input/output circuit 490.

The voltage signal VDD is supplied to the internal voltage generation circuit 400. The internal voltage generation circuit 400 generates a voltage signal GVDD having, for example, a voltage value of DC 7.5 V by boosting or dropping a voltage of the input voltage signal VDD. The voltage signal GVDD is input to various configurations of the integrated circuit 500 including a gate driver 540 which will be described below.

The amplification control signal generation circuit 502 generates amplification control signals Hgd and Lgd based on a data signal that defines a waveform of the drive signal COM included in the drive data signal DATA input from a terminal DATA-In. The amplification control signal generation circuit 502 includes a DAC interface (DAC_I/F: Digital to Analog Converter Interface) 510, a DAC section 520, a modulator 530, and the gate driver 540.

The drive data signal DATA supplied from the terminal DATA-In and the clock signal MCK supplied from the terminal MCK-In are input to the DAC interface 510. The DAC interface 510 integrates the drive data signal DATA based on the clock signal MCK, and generates, for example, 10-bit drive data dA that defines a waveform of the drive signal COM. The drive data dA is input to the DAC section 520. The DAC section 520 converts the drive data dA which is input into an original drive signal aA of an analog signal. The original drive signal aA is a target signal before the drive signal COM is amplified. The modulator 530 receives the original drive signal aA. The modulator 530 outputs a modulation signal Ms obtained by performing a pulse width modulation of the original drive signal aA. In other words, the modulator 530 modulates the original drive signal aA and outputs the modulation signal Ms. The gate driver 540 receives the voltage signals VHVab and GVDD, and the modulation signal Ms. The gate driver 540 amplifies the input modulation signal Ms based on the voltage signal GVDD and generates the amplification control signal Hgd that is level-shifted to a high amplitude logic based on the voltage signal VHVab, and the amplification control signal Lgd obtained by inverting a logic level of the input modulation signal Ms and amplifying the modulation signal MS based on the voltage signal GVDD. That is, the amplification control signal Hgd and the amplification control signal Lgd are exclusively at an H level.

Here, being exclusively at an H level includes that the amplification control signal Hgd and the amplification control signal Lgd are not at the H level at the same time. Thus, the gate driver 540 may control timing at which the amplification control signal Hgd and the amplification control signal Lgd go to the H level such that the amplification control signal Hgd and the amplification control signal Lgd do not go to the H level at the same time, and may include a timing controller.

The amplification control signal Hgd is output from the integrated circuit 500 via a terminal Hg-Out and is input to the amplification circuit 550. Likewise, the amplification control signal Lgd is output from the integrated circuit 500 via a terminal Lg-Out and is input to the amplification circuit 550. Here, the amplification control signal Hgd is obtained by level-shifting a logic level of the modulation signal Ms, and the amplification control signal Lgd is obtained by inverting the logic level of the modulation signal Ms. Thus, the amplification control signal Hgd and the amplification control signal Lgd also correspond to a modulation signal generated by the modulator 530 in a broad sense.

The amplification circuit 550 outputs an amplification modulation signal AMs by operating based on the amplification control signals Hgd and Lgd. In other words, the amplification circuit 550 amplifies the modulation signal Ms and outputs the amplification modulation signal AMs. The amplification circuit 550 includes transistors 551 and 552. Each of the transistors 551 and 552 is, for example, an N-channel field effect transistor (FET).

The voltage signal VHV is supplied to a drain terminal of the transistor 551. The amplification control signal Hgd is supplied to a gate terminal of the transistor 551 via the terminal Hg-Out. A source terminal of the transistor 551 is electrically coupled to a drain terminal of the transistor 552. The amplification control signal Lgd is supplied to a gate terminal of the transistor 552 via the terminal Lg-Out. A ground potential is supplied to a source terminal of the transistor 552. The transistor 551 coupled as described above operates according to the amplification control signal Hgd, and the transistor 552 operates according to the amplification control signal Lgd that is exclusively at an H level with respect to the amplification control signal Hgd. That is, the transistors 551 and 552 are exclusively turned on. Thereby, the amplification modulation signal AMs obtained by amplifying the modulation signal Ms based on the voltage signal VHVab is generated at a coupling point between the source terminal of the transistor 551 and the drain terminal of the transistor 552.

The amplification modulation signal AMs generated by the amplification circuit 550 is input to a demodulation circuit 560. The demodulation circuit 560 includes a coil 561 and a capacitor 562. One end of the coil 561 is electrically coupled to the source terminal of the transistor 551 and the drain terminal of the transistor 552. Further, the other end of the coil 561 is electrically coupled to one end of the capacitor 562. The other end of the capacitor 562 receives the ground potential. That is, the coil 561 and the capacitor 562 configure a low-pass filter. As the amplification modulation signal AMs is supplied to the demodulation circuit 560, the amplification modulation signal AMs is demodulated, and the drive signal COM is generated. That is, the demodulation circuit 560 generates the drive signal COM by demodulating the amplification modulation signal AMs and outputs the generated drive signal COM from a terminal COM-Out.

Further, the drive signal COM generated by the demodulation circuit 560 is fed back to the modulator 530 via the feedback circuit 570. In other words, the feedback circuit 570 feeds back the drive signal COM to the modulator 530. The feedback circuit 570 includes resistors 571 and 572. One end of the resistor 571 is electrically coupled to the other end of the coil 561, and the other end of the resistor 571 is electrically coupled to one end of the resistor 572. The other end of the resistor 572 receives the voltage signal VHV2. The other end of the resistor 571 and one end of the resistor 572 are electrically coupled to the modulator 530 via a terminal Com-Dis. That is, the drive signal COM is pulled up by the voltage signal VHV2 via the feedback circuit 570 and is fed back to the modulator 530.

As described above, the amplification control signal generation circuit 502, the amplification circuit 550, the demodulation circuit 560, and the feedback circuit 570 included in the integrated circuit 500 generate the drive signal COM for driving the piezoelectric element 60 based on the drive data signal DATA. The generated drive signal COM is supplied to the electrode 611 of the piezoelectric element 60. Here, the drive signal output circuit 501 outputs a signal, which includes the trapezoidal waveforms Adp, Bdp, and Cdp illustrated in FIG. 5 as a drive signal COM, for driving the piezoelectric element 60, and can also output a signal having a constant voltage value as the drive signal COM when the drive data signal DATA indicating a constant voltage value is supplied.

As described above, a configuration including the amplification control signal generation circuit 502, the amplification circuit 550, the demodulation circuit 560, and the feedback circuit 570 corresponds to the drive signal output circuit 501. The terminal COM-Out from which the drive signal COM generated by the drive signal output circuit 501 is output is electrically coupled to the terminal TG-In of the selection circuit 230 illustrated in FIG. 7.

The oscillation circuit 410 outputs a clock signal LCK that defines an operation timing of the integrated circuit 500. The clock signal LCK is input to the clock selection circuit 411 and the abnormality detection circuit 430.

The clock signals MCK and LCK and a clock selection signal CSW are input to the clock selection circuit 411. The clock selection circuit 411 switches whether to output the clock signal MCK as a clock signal RCK to a register control circuit 440 based on a logic level of the clock selection signal CSW or to output the clock signal LCK to the register control circuit 440 as the clock signal RCK. In the present embodiment, description will be made on the assumption that the clock selection circuit 411 outputs the clock signal MCK to the register control circuit 440 as the clock signal RCK when the clock selection signal CSW is at an H level and outputs the clock signal LCK to the register control circuit 440 as the clock signal RCK when the clock selection signal CSW is at an L level.

The abnormality detection circuit 430 includes an oscillation abnormality detector 431, an operation abnormality detector 432, and a power supply voltage abnormality detector 433.

The clock signal LCK output from the oscillation circuit 410 is input to the oscillation abnormality detector 431. The oscillation abnormality detector 431 detects whether or not the input clock signal LCK is normal, and outputs the clock selection signal CSW and an error signal NES of a logic level based on the detection result. For example, the oscillation abnormality detector 431 detects at least one of a frequency and a voltage value of the clock signal LCK. When it is detected that at least one of the frequency and the voltage value of the clock signal LCK is abnormal, the oscillation abnormality detector 431 outputs the clock selection signal CSW and the error signal NES indicating abnormality to each of the clock selection circuit 411 and the register control circuits 440. Further, when both the frequency and the voltage value of the clock signal LCK are normal, the oscillation abnormality detector 431 outputs the clock selection signal CSW and the error signal NES indicating that the clock signal LCK is normal to each of the clock selection circuit 411 and the register control circuit 440.

An operation state signal ASS indicating operation states of various configuration elements of the drive control circuit 51 is input to the operation abnormality detector 432. The operation abnormality detector 432 detects whether or not various configuration elements of the drive control circuit 51 normally operate based on the input operation state signal ASS. In the present embodiment, when any of the various configurations of the drive control circuit 51 is abnormal, the operation state signal ASS indicating the abnormality is input to the operation abnormality detector 432. When the operation state signal ASS indicating the abnormality is input to the operation abnormality detector 432, the operation abnormality detector 432 outputs the error signal NES indicating the abnormality to the register control circuit 440.

The voltage signal VHV2 which is output from the drive circuit 50 and is supplied to the ejecting module 21 is input to the power supply voltage abnormality detector 433. The power supply voltage abnormality detector 433 detects a voltage value of the voltage signal VHV2. The power supply voltage abnormality detector 433 detects whether or not the voltage value of the voltage signal VHV2 supplied to the ejecting module 21 is normal based on the voltage value of the voltage signal VHV2. When it is determined that the voltage value of the voltage signal VHV2 supplied to the ejecting module 21 is abnormal, the power supply voltage abnormality detector 433 outputs an error signal FES indicating abnormality to the register control circuit 440.

Here, the power supply voltage abnormality detector 433 detects a voltage value of the reference voltage signal VBS1 output from the VBS supply control circuit 80, and may detect whether or not the voltage value of the reference voltage signal VBS1 is normal. In that case, when it is determined that the voltage value of the reference voltage signal VBS1 is abnormal, the power supply voltage abnormality detector 433 may output the error signal FES indicating the abnormality to the register control circuit 440.

The register control circuit 440 includes a sequence register 441, a state register 442, and a register controller 443. The sequence register 441 and the state register 442 hold operation information and the like input as the drive data signal DATA in synchronization with the clock signal MCK. The register controller 443 generates control signals CNT1 to CNT5 based on the information held in the sequence register 441 and the state register 442 in synchronization with the clock signal RCK, and outputs the generated signals to the corresponding configurations.

The control signal CNT1 is input to the drive signal discharging circuit 450. The drive signal discharging circuit 450 controls whether or not to release the stored electric charges based on the drive signal COM output from the demodulation circuit 560 via the feedback circuit 570. The drive signal discharging circuit 450 is electrically coupled to a propagation path through which the drive signal COM output from the demodulation circuit 560 is propagated, via the feedback circuit 570 and the terminal Com-Dis.

Figure 17:
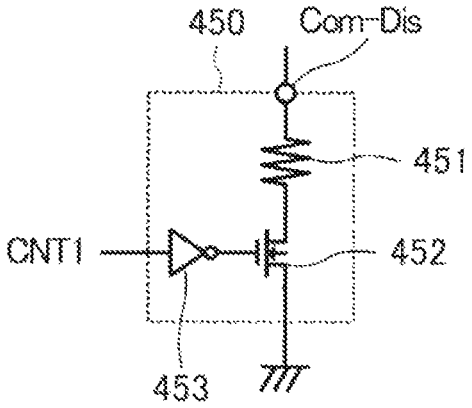
FIG. 17 is a diagram illustrating an example of a configuration of a drive signal discharging circuit.

FIG. 17 is a diagram illustrating an example of a configuration of the drive signal discharging circuit 450. The drive signal discharging circuit 450 includes a resistor 451, a transistor 452, and an inverter 453. Description will be made on the assumption that the transistor 452 is an NMOS transistor.

One end of the resistor 451 is electrically coupled to the terminal Com-Dis. The other end of the resistor 451 is electrically coupled to a drain terminal of the transistor 452. A ground potential is supplied to a source terminal of the transistor 452. The control signal CNT1 is input to a gate terminal of the transistor 452 via the inverter 453. When the control signal CNT1 of an H level is input to the drive signal discharging circuit 450 configured as described above, the transistor 452 is turned off. Thus, the drive signal discharging circuit 450 does not release the electric charges stored in a propagation path through which the drive signal COM is propagated. Meanwhile, when the control signal CNT1 of an L level is input to the drive signal discharging circuit 450, the transistor 452 is turned on. Thus, the drive signal discharging circuit 450 discharges the electric charges stored in the propagation path through which the drive signal COM is propagated via the feedback circuit 570, via the resistor 451 and the transistor 452. As described above, the drive signal discharging circuit 450 controls whether or not to release the electric charges stored in the propagation path through which the drive signal COM is supplied to the ejecting module 21, based on the control signal CNT1.

The control signal CNT2 is input to the VBS control signal output circuit 460. The VBS control signal output circuit 460 outputs the VBS control signal VBS_CNT supplied to the VBS supply control circuit 80.

Figure 18:
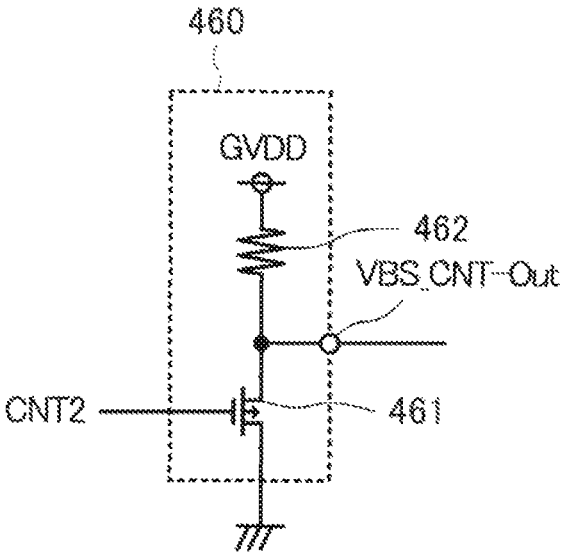
FIG. 18 is a diagram illustrating a configuration of a VBS control signal output circuit.

FIG. 18 is a diagram illustrating a structure of the VBS control signal output circuit 460. The VBS control signal output circuit 460 includes a transistor 461 and a resistor 462. Description will be made on the assumption that the transistor 471 is a PMOS transistor.

A source terminal of the transistor 461 is electrically coupled to one end of the resistor 462 and a terminal VBS_CNT-Out. Further, the voltage signal GVDD is supplied to the other end of the resistor 462. The ground potential is supplied to a drain terminal of the transistor 461. The control signal CNT2 is input to a gate terminal of the transistor 461. When the control signal CNT2 of an H level is input to the VBS control signal output circuit 460 configured as described above, the voltage signal GVDD is supplied to the terminal VBS_CNT-Out via the resistor 462, and when the control signal CNT2 of an L level is input, the ground potential is supplied to the terminal VBS_CNT-Out.

The VBS control signal VBS_CNT output from the VBS control signal output circuit 460 is input to the VBS supply control circuit 80 as illustrated in FIG. 3A. The VBS supply control circuit 80 switches whether or not to supply the reference voltage signal VBS1 to the ejecting module 21 as the reference voltage signal VBS2, based on a logic level of the input VBS control signal VBS_CNT.

The control signal CNT3 is input to the VHV control signal output circuit 470. The VHV control signal output circuit 470 outputs the VHV control signal VHV_CNT supplied to the power supply voltage control circuit 70.

Figure 19:
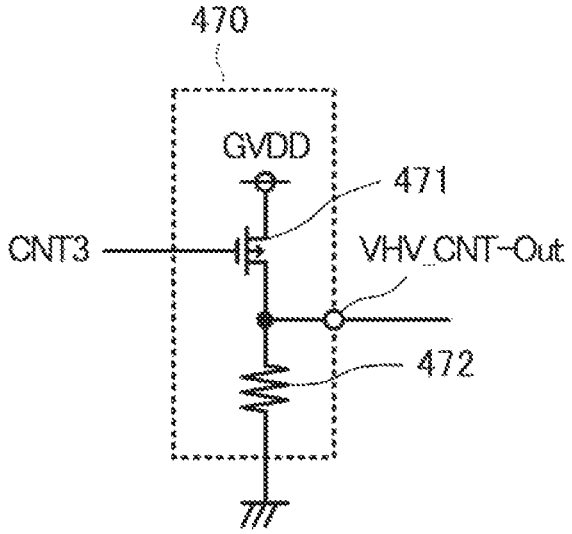
FIG. 19 is a diagram illustrating a configuration of a VHV control signal output circuit.

FIG. 19 is a diagram illustrating a structure of the VHV control signal output circuit 470. The VHV control signal output circuit 470 includes a transistor 471 and a resistor 472. Description will be made on the assumption that the transistor 471 is a PMOS transistor.

The voltage signal GVDD is supplied to a source terminal of the transistor 471. A drain terminal of the transistor 471 is electrically coupled to one end of the resistor 472 and a terminal VHV_CNT-Out. The control signal CNT3 is input to a gate terminal of the transistor 471. The ground potential is supplied to the other end of the resistor 472. When the control signal CNT3 of an L level is input to the VHV control signal output circuit 470 configured as described above, the voltage signal GVDD is supplied to the terminal VHV_CNT-Out, and when the control signal CNT3 of an H level is input, the ground potential is supplied to the terminal VHV_CNT-Out via the resistor 472.

The VHV control signal VHV_CNT output from the VHV control signal output circuit 470 is input to the power supply voltage control circuit 70 as illustrated in FIG. 3A. The power supply voltage control circuit 70 switches whether or not to supply the voltage signal VHV1 to the ejecting module 21 as the voltage signal VHV2, based on a logic level of the input VHV control signal VHV_CNT.

The control signal CNT4 is input to the state signal input/output circuit 480. The state signal input/output circuit 480 outputs the state signal BUSY indicating an operation state of the drive control circuit 51 and also receives the state signal BUSY output from another configuration. Here, for example, another configuration may be any one of the drive control circuits 51-1 to 51-4 included in the liquid ejecting apparatus 1 or may be the control signal output circuit 100.

Figure 20:
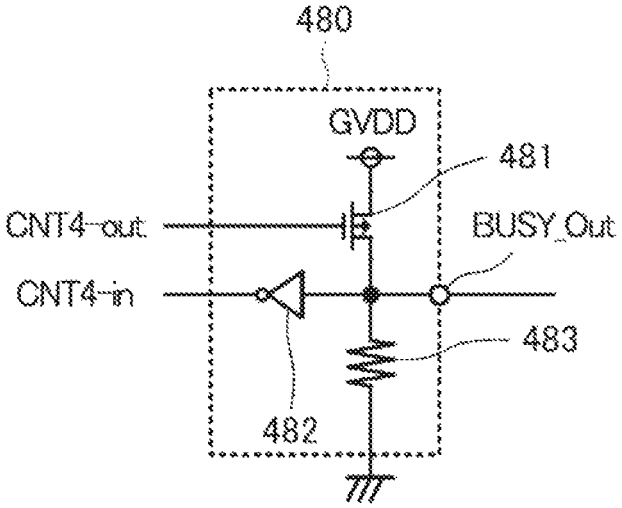
FIG. 20 is a diagram illustrating a configuration of a state signal input/output circuit.

FIG. 20 is a diagram illustrating a configuration of the state signal input/output circuit 480. The state signal input/output circuit 480 includes a transistor 481, an inverter 482, and a resistor 483. Description will be made on the assumption that the transistor 481 is a PMOS transistor. Further, the inverter 482 functions as a COMS input terminal of the integrated circuit 500. That is, the state signal input/output circuit 480 outputs the state signal BUSY from the terminal BUSY-Out and inputs a signal input to a terminal BUSY-Out to the register control circuit 440, based on the control signal CNT4 output from the register control circuit 440. In FIG. 20, the control signal CNT4 output from the register control circuit 440 is illustrated as a control signal CNT4-out, and the control signal CNT4 input to the register control circuit 440 is illustrated as a control signal CNT4-in.

The voltage signal GVDD is supplied to a source terminal of the transistor 481. A drain terminal of the transistor 481 is coupled to an input end of the inverter 482, one end of the resistor 483, and a terminal BUSY-Out. Further, the control signal CNT4-out output from the register control circuit 440 is input to a gate terminal of the transistor 481. Further, the control signal CNT4-in is output from an output end of the inverter 482 to the register control circuit 440. The ground potential is supplied to the other end of the resistor 483. When the control signal CNT4 of an L level is input to the state signal input/output circuit 480 configured as described above, the voltage signal GVDD is supplied to the terminal BUSY-Out. That is, the state signal BUSY of an H level is output.

The control signal CNT5 is input to the abnormality signal input/output circuit 490. The abnormality signal input/output circuit 490 outputs the abnormality signal ERR indicating whether or not the drive control circuit 51 is abnormal, and receives the abnormality signal ERR output from another configuration. Here, for example, another configuration may be any one of the drive control circuits 51-1 to 51-4 included in the liquid ejecting apparatus 1 or may be the control signal output circuit 100.

Figure 21:
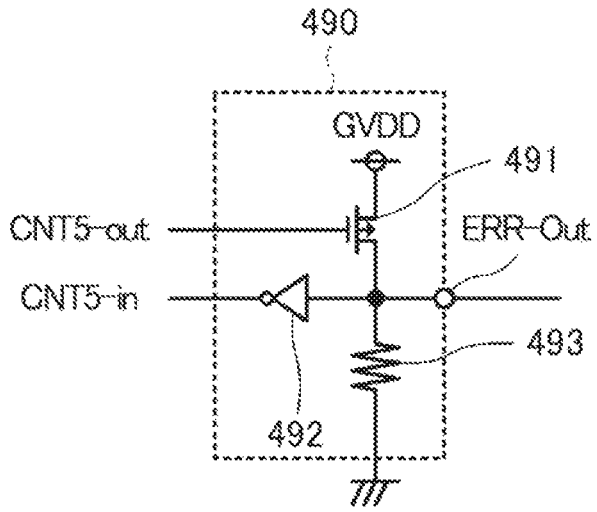
FIG. 21 is a diagram illustrating a configuration of an abnormality signal input/output circuit.

FIG. 21 is a diagram illustrating a configuration of the abnormality signal input/output circuit 490. The abnormality signal input/output circuit 490 includes a transistor 491, an inverter 492, and a resistor 493. In the following description, the transistor 491 will be described as a PMOS transistor. Further, the inverter 492 functions as a COMS input terminal of the integrated circuit 500. That is, the abnormality signal input/output circuit 490 outputs the abnormality signal ERR from a terminal ERR-Out based on the control signal CNT5 output from the register control circuit 440, and inputs the signal input to the terminal ERR-Out to the register control circuit 440. In FIG. 21, the control signal CNT5 output from the register control circuit 440 is illustrated as a control signal CNT5-out, and the control signal CNT5 input to the register control circuit 440 is illustrated as a control signal CNT5-in.

The voltage signal GVDD is supplied to a source terminal of the transistor 491. A drain terminal of the transistor 491 is electrically coupled to an input end of the inverter 492, one end of the resistor 493, and the terminal ERR-Out. Further, the control signal CNT5-out output from the register control circuit 440 is input to a gate terminal of the transistor 491. The control signal CNT5-in is output to the register control circuit 440 from an output end of the inverter 492. Further, the ground potential is supplied to the other end of the resistor 493. When the control signal CNT5 of an L level is input to the abnormality signal input/output circuit 490 configured as described above, the voltage signal GVDD is supplied to the terminal ERR-Out. That is, the abnormality signal ERR of an H level is output.

As described above, in the drive circuit 50 according to the present embodiment, each of the drive control circuits 51-1 to 51-4 includes the abnormality signal input/output circuit 490 coupled to each other by a wired OR. Thereby, when any of the drive control circuits 51-1 to 51-4 is abnormal, abnormality information can be propagated to the normal drive control circuits 51-1 to 51-4. It is possible to control whether operations of the normal drive control circuits 51-1 to 51-4 are continued or stopped, according to the propagated abnormality information. Thus, both convenience and safety of the liquid ejecting apparatus 1 can be further enhanced.

Further, the register control circuit 440 generates drive data dC1 for outputting the drive signal COM having a constant voltage value at the voltage Vos from the drive signal output circuit 501 based on the input drive data signal DATA and inputs the drive data to the DAC section 520. The drive data dC1 output by the register control circuit 440 may be changeable, and thereby, it is possible to randomly change the voltage Vos which is a voltage value of the drive signal COM defined by the drive data dC1.

The DAC section 520 converts the drive data dC1 input from the register control circuit 440 into the original drive signal aA that is an analog signal. The original drive signal aA is a target signal before amplification of the drive signal COM having a constant voltage value. The modulator 530 receives the original drive signal aA. The modulator 530 outputs a modulation signal Ms obtained by performing a pulse width modulation of the original drive signal aA. The gate driver 540 amplifies the input modulation signal Ms based on the voltage signal GVDD and generates the amplification control signal Hgd that is level-shifted to a high amplitude logic based on the voltage signal VHVab, and the amplification control signal Lgd obtained by inverting a logic level of the input modulation signal Ms and amplifying the modulation signal MS based on the voltage signal GVDD. The amplification circuit 550 operates based on the amplification control signals Hgd and Lgd to output the amplification modulation signal AMs, and the demodulation circuit 560 demodulates the amplification modulation signal to output the drive signal COM having a constant voltage value at the voltage Vos.

Further, the register control circuit 440 generates drive data dC2 and outputs the drive data dC2 to the constant voltage output circuit 420. The constant voltage output circuit 420 generates a voltage signal VCNT having a constant voltage value at a voltage Vcnt based on the input drive data dC2 and outputs the voltage signal VCNT to the terminal Com-Dis. In other words, the constant voltage output circuit 420 makes a voltage value of the terminal Com-Dis constant at the voltage Vcnt based on the drive data dC2. Here, the terminal Com-Dis is electrically coupled to a wire through which the drive signal COM is propagated via the resistor 571. That is, the constant voltage output circuit 420 is electrically coupled to the electrode 611 of the piezoelectric element 60 in the same manner as the drive signal output circuit 501, and controls a voltage value of the wire through which the drive signal COM is propagated to be constant at the voltage Vcnt.

Figure 22:
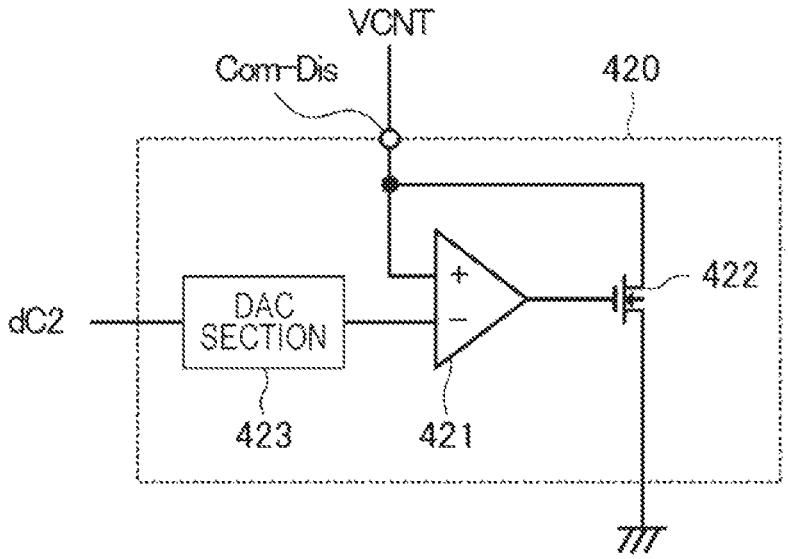
FIG. 22 is a diagram illustrating an example of a configuration of a constant voltage output circuit.

FIG. 22 is a diagram illustrating an example of a configuration of the constant voltage output circuit 420. The constant voltage output circuit 420 includes a comparator 421, a transistor 422, and a DAC 423. Description will be made on the assumption that the transistor 422 is an NMOS transistor.

The drive data dC2 is input to the DAC 423. The DAC 423 inputs a signal having of a voltage value corresponding to the input drive data dC2 to a negative input end of the comparator 421. Here, the DAC 423 may include a variable DC power supply that outputs a signal having a voltage value according to the input drive data dC2. A positive input end of the comparator 421 is electrically coupled to the terminal Com-Dis. An output end of the comparator 421 is electrically coupled to a gate terminal of the transistor 422. A drain terminal of the transistor 422 is electrically coupled to the terminal Com-Dis. Further, the ground potential is supplied to a source terminal of the transistor 422.

In the constant voltage output circuit 420 configured as described above, when a voltage value supplied to the positive input end of the comparator 421 is greater than a voltage value supplied to the negative input end of the comparator 421, the comparator 421 outputs a signal of an H level. That is, when a voltage value of the terminal Com-Dis is greater than a voltage value output from the DAC 423 defined by the drive data dC2, the comparator 421 outputs the signal of an H level. Thus, the transistor 422 is turned on. As a result, the voltage value of the terminal Com-Dis is reduced. Meanwhile, when the voltage value supplied to the positive input end of the comparator 421 is less than the voltage value supplied to the negative input end of the comparator 421, the comparator 421 outputs a signal of an L level. That is, when the voltage value of the terminal Com-Dis is less than a voltage value output from the DAC 423 defined by the drive data dC2, the comparator 421 outputs the signal of an L level. Thus, the transistor 422 is turned off. As a result, the voltage signal VHV2 is supplied to the terminal Com-Dis via the resistor 572, and the voltage value of the terminal Com-Dis is increased.

Thus, the constant voltage output circuit 420 controls an operation of the transistor 422 such that the voltage value of the terminal Com-Dis becomes the voltage Vcnt defined by the drive data dC2 output from the DAC 423. Here, the drive data dC1 and dC2 output by the register control circuit 440 may be obtained by reading in advance a value stored in a register (not illustrated) by the register control circuit 440, or may be appropriately changed based on the drive data signal DATA input to the drive circuit 50.

6. Supply Control of Reference Voltage Signal and Voltage Signal VHV in Drive Circuit In the drive circuit 50 and the head unit 20 configured as described above, a method of controlling supply switching of the drive circuit 50 when the voltage signal VHV1 is supplied to the head unit 20 as the voltage signals VHV2-1 and VHV2-2, and a method of controlling supply switching of the drive circuit 50 when the reference voltage signal VBS is supplied to the head unit 20 as the reference voltage signals VBS1 and VBS2 will be described.

Here, as described above, the drive signal COM1 output from the drive control circuit 51-1 is supplied to the electrode 611 of the piezoelectric element 60 included in the head 22-1 via the drive signal selection control circuit 200-1 as the drive signal VOUT1. The piezoelectric element 60 included in the head 22-1 is driven based on the supplied drive signal VOUT1. That is, the drive control circuit 51-1 is electrically coupled to the electrode 611 of the piezoelectric element 60 included in the head 22-1 via the drive signal selection control circuit 200-1 and outputs the drive signal COM1 for driving the piezoelectric element 60 included in the head 22-1. The drive control circuit 51-1 is an example of a first drive signal output circuit, and the drive signal COM1 output by the drive control circuit 51-1 is an example of a first drive signal. The drive signal VOUT1 is generated by selecting or deselecting the trapezoidal waveforms Adp, Bdp, and Cdp included in the drive signal COM1. Thus, it can be said that the drive signal VOUT1 is also an example of the first drive signal.

Likewise, the drive signal COM2 output from the drive control circuit 51-2 is supplied to the electrode 611 of the piezoelectric element 60 included in the head 22-2 via the drive signal selection control circuit 200-2 as the drive signal VOUT2. The piezoelectric element 60 included in the head 22-2 is driven based on the supplied drive signal VOUT2. That is, the drive control circuit 51-2 is electrically coupled to the electrode 611 of the piezoelectric element 60 included in the head 22-2 via the drive signal selection control circuit 200-2 and outputs the drive signal COM2 for driving the piezoelectric element 60 included in the head 22-2. The drive control circuit 51-2 is an example of a second drive signal output circuit, and the drive signal COM2 output by the drive control circuit 51-2 is an example of a second drive signal. The drive signal VOUT2 is generated by selecting or deselecting the trapezoidal waveforms Adp, Bdp, and Cdp included in the drive signal COM2. Thus, it can be said that the drive signal VOUT2 is also an example of the second drive signal.

Likewise, the drive signal COM3 output from the drive control circuit 51-3 is supplied to the electrode 611 of the piezoelectric element 60 included in the head 22-3 via the drive signal selection control circuit 200-3 as the drive signal VOUT3. The piezoelectric element 60 included in the head 22-3 is driven based on the supplied drive signal VOUT3. That is, the drive control circuit 51-3 is electrically coupled to the electrode 611 of the piezoelectric element 60 included in the head 22-3 via the drive signal selection control circuit 200-3 and outputs the drive signal COM3 for driving the piezoelectric element 60 included in the head 22-3. The drive control circuit 51-3 is an example of a third drive signal output circuit, and the drive signal COM3 output by the drive control circuit 51-3 is an example of a third drive signal. The drive signal VOUT3 is generated by selecting or deselecting the trapezoidal waveforms Adp, Bdp, and Cdp included in the drive signal COM3. Thus, it can be said that the drive signal VOUT3 is also an example of the third drive signal.

Likewise, the drive signal COM4 output from the drive control circuit 51-4 is supplied to the electrode 611 of the piezoelectric element 60 included in the head 22-4 via the drive signal selection control circuit 200-4 as the drive signal VOUT4. The piezoelectric element 60 included in the head 22-4 is driven based on the supplied drive signal VOUT4. That is, the drive control circuit 51-4 is electrically coupled to the electrode 611 of the piezoelectric element 60 included in the head 22-4 via the drive signal selection control circuit 200-4 and outputs the drive signal COM4 for driving the piezoelectric element 60 included in the head 22-4. The drive control circuit 51-4 is an example of a fourth drive signal output circuit, and the drive signal COM4 output by the drive control circuit 51-4 is an example of a fourth drive signal. The drive signal VOUT4 is generated by selecting or deselecting the trapezoidal waveforms Adp, Bdp, and Cdp included in the drive signal COM4. Thus, it can be said that the drive signal VOUT4 is also an example of the fourth drive signal.

6.1. Supply Control of Voltage Signal VHV in Power Supply Voltage Control Circuit As described above, the drive circuit 50 includes the drive control circuits 51-1 to 51-4 and the power supply voltage control circuits 70-1 and 70-2 that control whether or not to supply the voltage signal VHV1 to the head unit 20 as the voltage signal VHV2. In the drive circuit 50, the drive control circuits 51-1 to 51-4 and the power supply voltage control circuits 70-1 and 70-2 control whether or not to supply the voltage signal VHV1 to the drive signal selection control circuits 200-1 to 200-4 as the voltage signals VHV2-1 and VHV2-2.

As illustrated in FIGS. 3A and 3B, the power supply voltage control circuit 70-1 is electrically coupled to the selection circuit 230 included in the drive signal selection control circuit 200-1 and the selection circuit 230 included in the drive signal selection control circuit 200-2, and is not electrically coupled to the selection circuit 230 included in the drive signal selection control circuit 200-3 and the selection circuit 230 included in the drive signal selection control circuit 200-4. The power supply voltage control circuit 70-1 controls supply of the voltage signal VHV2-1 to the selection circuit 230 included in the drive signal selection control circuit 200-1 and the selection circuit 230 included in the drive signal selection control circuit 200-2.

Likewise, the power supply voltage control circuit 70-2 is electrically coupled to the selection circuit 230 included in the drive signal selection control circuit 200-3 and the selection circuit 230 included in the drive signal selection control circuit 200-4 and is not electrically coupled to the selection circuit 230 included in the drive signal selection control circuit 200-1 and the selection circuit 230 included in the drive signal selection control circuit 200-2. The power supply voltage control circuit 70-2 controls supply of the voltage signal VHV2-1 to the selection circuit 230 included in the drive signal selection control circuit 200-3 and the selection circuit 230 included in the drive signal selection control circuit 200-4.

Further, the drive control circuit 51-1 is electrically coupled to the power supply voltage control circuit 70-1. The drive control circuit 51-1 outputs the VHV control signal VHV_CNT1 that controls the power supply voltage control circuit 70-1. Likewise, the drive control circuit 51-2 is electrically coupled to the power supply voltage control circuit 70-1. The drive control circuit 51-2 outputs the VHV control signal VHV_CNT2 that controls the power supply voltage control circuit 70-1. In other words, the drive control circuit 51-1 is not electrically coupled to the power supply voltage control circuit 70-2, and the drive control circuit 51-2 is not electrically coupled to the power supply voltage control circuit 70-2.

Further, the drive control circuit 51-3 is electrically coupled to the power supply voltage control circuit 70-2. The drive control circuit 51-3 outputs the VHV control signal VHV_CNT3 that controls the power supply voltage control circuit 70-2. Likewise, the drive control circuit 51-4 is electrically coupled to the power supply voltage control circuit 70-2. The drive control circuit 51-4 outputs the VHV control signal VHV_CNT4 that controls the power supply voltage control circuit 70-2. In other words, the drive control circuit 51-3 is not electrically coupled to the power supply voltage control circuit 70-1, and the drive control circuit 51-4 is not electrically coupled to the power supply voltage control circuit 70-1.

Thus, the power supply voltage control circuit 70-1 receives signals corresponding to logic levels of the VHV control signals VHV_CNT1 and VHV_CNT2, and the power supply voltage control circuit 70-2 receives signals corresponding to logic levels of the VHV control signals VHV_CNT3 and VHV_CNT4.

As illustrated in FIGS. 10 to 12, the power supply voltage control circuit 70-1 controls whether or not to output the voltage signal VHV1 as the voltage signal VHVa based on a logic level of an input signal. The voltage signal VHVa output from the power supply voltage control circuit 70-1 is supplied to the drive signal selection control circuits 200-1 and 200-2 via the fuse F1 as the voltage signal VHV2-1. That is, the power supply voltage control circuit 70-1 controls whether or not to supply the voltage signal VHV2-1 to the drive signal selection control circuits 200-1 and 200-2 based on a logic level of a signal that is input according to the logic levels of the VHV control signals VHV_CNT1 and VHV_CNT2.

Specifically, when both the VHV control signal VHV_CNT1 output by the drive control circuit 51-1 and the VHV control signal VHV_CNT2 output by the drive control circuit 51-2 are at an L level, the power supply voltage control circuit 70-1 does not supply the voltage signal VHV1 to the drive signal selection control circuits 200-1 and 200-2 as the voltage signal VHV2-1. Meanwhile, when at least one of the VHV control signal VHV_CNT1 output by the drive control circuit 51-1 and the VHV control signal VHV_CNT2 output by the drive control circuit 51-2 is at an H level, the power supply voltage control circuit 70-1 supplies the voltage signal VHV1 to the drive signal selection control circuits 200-1 and 200-2 as the voltage signal VHV2-1.

Likewise, the power supply voltage control circuit 70-2 controls whether or not to output the voltage signal VHV1 as the voltage signal VHVb based on a logic level of an input signal. The voltage signal VHVb output from the power supply voltage control circuit 70-2 is supplied to the drive signal selection control circuits 200-3 and 200-4 via the fuse F2 as the voltage signal VHV2-2. That is, the power supply voltage control circuit 70-2 controls whether or not to supply the voltage signal VHV2-2 to the drive signal selection control circuits 200-1 and 200-2 based on a logic level of a signal which is input according to the logic levels of the VHV control signals VHV_CNT3 and VHV_CNT4.

Specifically, when both the VHV control signal VHV_CNT3 output by the drive control circuit 51-3 and the VHV control signal VHV_CNT4 output by the drive control circuit 51-4 are at an L level, the power supply voltage control circuit 70-2 does not supply the voltage signal VHV1 to the drive signal selection control circuits 200-3 and 200-4 as the voltage signal VHV2-2. Meanwhile, when at least one of the VHV control signal VHV_CNT3 output by the drive control circuit 51-3 and the VHV control signal VHV_CNT4 output by the drive control circuit 51-4 is at an H level, the power supply voltage control circuit 70-2 supplies the voltage signal VHV1 to the drive signal selection control circuits 200-3 and 200-4 as the voltage signal VHV2-2.

Here, being electrically coupled means a state in which signals can be propagated between respective configurations by wires except a wire through which a power supply voltage for operating a circuit is propagated and a wire through which a ground voltage becoming a reference potential is propagated, and includes, for example, being coupled via a resistor, a switch element, and the like. Meanwhile, being not electrically coupled means a state in which signals cannot be propagated between respective configurations by wires except a wire through which a power supply voltage for operating a circuit is propagated and a wire through which a ground voltage becoming a reference potential is propagated, and means being not coupled to wires other than the wire through which the power supply voltage for operating the circuit is propagated and the wire through which the ground voltage becoming the reference potential is propagated. The same interpretation is used in the following description.

Operations of the drive control circuits 51-1 and 51-2 and the power supply voltage control circuit 70-1 will be described in detail. As illustrated in FIG. 19, when the drive control circuit 51-1 outputs the VHV control signal VHV_CNT1 of an L level, the transistor 471 of the VHV control signal output circuit 470 included in the drive control circuit 51-1 is turned off. Likewise, when the drive control circuit 51-2 outputs the VHV control signal VHV_CNT2 of an L level, the transistor 471 of the VHV control signal output circuit 470 included in the drive control circuit 51-2 is turned off. Thus, when both the VHV control signals VHV_CNT1 and VHV_CNT2 are at an L level, the power supply voltage control circuit 70-1 receives a signal of the ground potential via a resistor 472 of the VHV control signal output circuit 470 included in the drive control circuit 51-1 and the resistor 472 of the VHV control signal output circuit 470 included in the drive control circuit 51-2. That is, a signal of an L level is input to the power supply voltage control circuit 70-1. As a result, as illustrated in FIG. 11, the power supply voltage control circuit 70-1 does not supply the voltage signal VHV1 to the drive signal selection control circuits 200-1 and 200-2 as the voltage signal VHV2-1.

Meanwhile, as illustrated in FIG. 19, when the drive control circuit 51-1 outputs the VHV control signal VHV_CNT1 of an H level, the transistor 471 of the VHV control signal output circuit 470 included in the drive control circuit 51-1 is turned on. Thus, the drive control circuit 51-1 outputs the voltage signal GVDD supplied via the transistor 471 of the VHV control signal output circuit 470 as a signal of an H level. In this case, the VHV control signal VHV_CNT1 of an H level output from the drive control circuit 51-1 is held by the resistor 472 of the VHV control signal output circuit 470 included in the drive control circuit 51-1 and the resistor 472 of the VHV control signal output circuit 470 included in the drive control circuit 51-2. That is, when the VHV control signal VHV_CNT1 of an H level is output from the drive control circuit 51-1, the power supply voltage control circuit 70-1 receives a signal of an H level indicating that the voltage signal VHV1 is supplied to the drive signal selection control circuits 200-1 and 200-2 as the voltage signal VHV2-1 regardless of a logic level of the VHV control signal VHV_CNT2 output from the drive control circuit 51-2.

Likewise, when the VHV control signal VHV_CNT2 of an H level is output from the drive control circuit 51-2, the power supply voltage control circuit 70-1 receives a signal of an H level indicating that the voltage signal VHV1 is supplied to the drive signal selection control circuits 200-1 and 200-2 as the voltage signal VHV2-1 regardless of a logic level of the VHV control signal VHV_CNT1 output from the drive control circuit 51-1.

Details of operations of the drive control circuits 51-3 and 51-4 and the power supply voltage control circuit 70-2 are the same as details of the operations of the drive control circuits 51-1 and 51-2 and the power supply voltage control circuit 70-1, and thus, detailed description thereof is omitted.

As described above, the drive circuit 50 according to the present embodiment includes the drive signal selection control circuit 200-1 that generates the drive signal VOUT1 based on the drive signal COM1 output from the drive control circuit 51-1, and the drive signal selection control circuit 200-2 that generates the drive signal VOUT2 based on the drive signal COM2 output by the drive control circuit 51-2, and the drive signal selection control circuit 200-1 and the drive signal selection control circuits 200-1 and 200-2 are supplied with the voltage signal VHV2-1 as a common power supply voltage. Whether or not to supply the voltage signal VHV2-1 to the drive signal selection control circuits 200-1 and 200-2 as the power supply voltage is controlled by the drive control circuits 51-1 and 51-2 which supply the drive signals COM1 and COM2 to the drive signal selection control circuits 200-1 and 200-2, respectively.

Likewise, the drive circuit 50 according to the present embodiment includes the drive signal selection control circuit 200-3 that generates the drive signal VOUT3 based on the drive signal COM3 output by the drive control circuit 51-3, and the drive signal selection control circuit 200-4 that generates the drive signal VOUT4 based on the drive signal COM4 output by the drive control circuit 51-4, and the drive signal selection control circuits 200-3 and 200-4 are supplied with the voltage signal VHV2-2 as a common power supply voltage. Whether or not to supply the voltage signal VHV2-2 to the drive signal selection control circuits 200-3 and 200-4 as the power supply voltage is controlled by drive control circuits 51-3 and 51-4 that supply the drive signals COM3 and COM4 to the drive signal selection control circuits 200-1 and 200-2, respectively.

Thereby, in the liquid ejecting apparatus 1 including the drive signal selection control circuits 200-1 to 200-4 as a plurality of drive signal selection control circuits 200, even when there is an abnormal voltage value of the voltage signal VHV2 which is a power supply voltage supplied to any one of the drive signal selection control circuits 200, the drive signal selection control circuits 200 to which the normal voltage signal VHV2 is supplied can continuously operate. Thus, both convenience and safety of the liquid ejecting apparatus 1 can be further enhanced.

Here, in the above-described embodiments, although the drive control circuits 51-1 to 51-4 in the drive circuit 50 are described as determining logic levels of the VHV control signals VHV_CNT1 to VHV_CNT4 based on the drive data signals DATA1 to DATA4 input from the control signal output circuit 100 and as controlling whether or not the voltage signal VHV1 is supplied to the drive signal selection control circuits 200-1 to 200-4 as the voltage signals VHV2-1 and VHV2-2, the drive control circuits 51-1 to 51-4 may determine the logic levels of the VHV control signals VHV_CNT1 to VHV_CNT4 according to detection results of voltage values of the voltage signals VHV2-1 and VHVH2-2 of the power supply voltage abnormality detector 433 included in the abnormality detection circuit 430 included in each of the drive control circuits 51-1 to 51-4.

Specifically, when the power supply voltage abnormality detector 433 included in the drive control circuit 51-1 detects the voltage value of the voltage signal VHV2-1 and determines that the voltage value of the voltage signal VHV2-1 is abnormal, the drive control circuit 51-1 outputs the VHV control signal VHV_CNT1 of an L level indicating that the voltage signal VHV1 is not supplied to the ejecting modules 21-1 and 21-2 as the voltage signal VHV2-1 to the power supply voltage control circuit 70-1. Likewise, when the power supply voltage abnormality detector 433 included in the drive control circuit 51-2 detects the voltage value of the voltage signal VHV2-1 and determines that the voltage value of the voltage signal VHV2-1 is abnormal, the drive control circuit 51-2 outputs the VHV control signal VHV_CNT2 of an L level indicating that the voltage signal VHV1 is not supplied to the ejecting modules 21-1 and 21-2 as the voltage signal VHV2-1 to the power supply voltage control circuit 70-1.

Further, when the power supply voltage abnormality detector 433 included in the drive control circuit 51-3 detects the voltage value of the voltage signal VHV2-2 and determines that the voltage value of the voltage signal VHV2-2 is abnormal, the drive control circuit 51-3 outputs the VHV control signal VHV_CNT3 of an L level indicating that the voltage signal VHV1 is not supplied to the ejecting modules 21-3 and 21-4 as the voltage signal VHV2-2 to the power supply voltage control circuit 70-2. Likewise, when the power supply voltage abnormality detector 433 included in the drive control circuit 51-4 detects the voltage value of the voltage signal VHV2-2 and determines that the voltage value of the voltage signal VHV2-2 is abnormal, the drive control circuit 51-4 outputs the VHV control signal VHV_CNT4 of an L level indicating that the voltage signal VHV1 is not supplied to the ejecting modules 21-3 and 21-4 as the voltage signal VHV2-2 to the power supply voltage control circuit 70-2.

6.2. Supply Control of Reference Voltage Signal VBS of VBS Supply Control Circuit Further, as described above, the drive circuit 50 includes the drive control circuits 51-1 to 51-4 and the VBS supply control circuits 80-1 and 80-2 control whether or not to supply the reference voltage signal VBS1 to the head unit 20 as the reference voltage signals VBS2-1 and VB2-2.

As illustrated in FIGS. 3A and 3B, in the VBS supply control circuit 80-1, one end to which the reference voltage signal VBS1 is input is electrically coupled to the terminal VBS-Out of the reference voltage signal output circuit 30, and the other end from which the reference voltage signal VBS2-1 is output is electrically coupled to the electrode 612 of the piezoelectric element 60 included in the ejecting module 21-1 and the electrode 612 of the piezoelectric element 60 included in the ejecting module 21-2. In this case, the other end of the VBS supply control circuit 80-1 is not electrically coupled to the electrode 612 of the piezoelectric element 60 included in the ejecting module 21-3 and the electrode 612 of the piezoelectric element 60 included in the ejecting module 21-4. The VBS supply control circuit 80-1 switches whether or not to supply the reference voltage signal VBS1 to the electrode 612 of the piezoelectric element 60 included in the ejecting module 21-1 and the electrode 612 of the piezoelectric element 60 included in the ejecting module 21-2 as the reference voltage signal VBS2-1.

As illustrated in FIGS. 3A and 3B, the drive control circuit 51-1 is electrically coupled to the electrode 611 of the piezoelectric element 60 included in the ejecting module 21-1 via the selection circuit 230 included in the drive signal selection control circuit 200-1. The drive control circuit 51-1 is electrically coupled to the VBS supply control circuit 80-1 and outputs the VBS control signal VBS_CNT1 for controlling an operation of the VBS supply control circuit 80-1 to the VBS supply control circuit 80-1. Likewise, the drive control circuit 51-2 is electrically coupled to the electrode 611 of the piezoelectric element 60 included in the ejecting module 21-2 via the selection circuit 230 included in the drive signal selection control circuit 200-1. The drive control circuit 51-2 is electrically coupled to the VBS supply control circuit 80-1 and outputs the VBS control signal VBS_CNT2 for controlling the operation of the VBS supply control circuit 80-1 to the VBS supply control circuit 80-1.

Thus, the VBS supply control circuit 80-1 receives signals according to logic levels of the VBS control signals VBS_CNT1 and VBS_CNT2. The VBS supply control circuit 80-1 controls conduction or non-conduction between one end to which the reference voltage signal VBS1 is input and the other end from which the reference voltage signal VBS2-1 is output, based on a logic level of the input signal. Thereby, whether the reference voltage signal VBS1 is supplied to the electrode 612 of the piezoelectric element 60 included in the ejecting module 21-1 and the electrode 612 of the piezoelectric element included in the ejecting module 21-2 as the reference voltage signal VBS2-1 can be switched.

That is, the VBS supply control circuit 80-1 switches whether or not to supply the reference voltage signal VBS1 to the electrode 612 of the piezoelectric element 60 included in the ejecting module 21-1 and the electrode 612 of the piezoelectric element 60 included in the ejecting module 21-2 as the reference voltage signal VBS2-1, according to the VBS control signal VBS_CNT1 output from the drive control circuit 51-1 and the VBS control signal VBS_CNT2 output from the drive control circuit 51-2. Here, the VBS control signal VBS_CNT1 is an example of a first control signal, and the VBS control signal VBS_CNT2 is an example of a second control signal.

Here, a relationship between logic levels of the VBS control signal VBS_CNT1 output from the drive control circuit 51-1 and the VBS control signal VBS_CNT2 output from the drive control circuit 51-2 and a logic level of a signal input to the VBS supply control circuit 80-1 will be described.

As illustrated in FIG. 18, when the drive control circuit 51-1 outputs the VBS control signal VBS_CNT1 of an H level, the transistor 461 of the VBS control signal output circuit 460 included in the drive control circuit 51-1 is turned off. Likewise, when the drive control circuit 51-2 outputs the VBS control signal VBS_CNT2 of an H level, the transistor 461 of the VBS control signal output circuit 460 included in the drive control circuit 51-2 is turned off. Thus, when both the VBS control signal VBS_CNT1 and the VBS control signal VBS_CNT2 are at an H level, the VBS supply control circuit 80-1 receives the voltage signal GVDD via the resistor 462 of the VBS control signal output circuit 460 included in the drive control circuit 51-1 and the resistor 462 of the VBS control signal output circuit 460 included in the drive control circuit 51-2. In other words, a signal of an H level is input to the VBS supply control circuit 80-1. As a result, as illustrated in FIG. 15, the VBS supply control circuit 80-1 supplies the reference voltage signal VBS1 to the ejecting modules 21-1 and 21-2 as the reference voltage signal VBS2-1.

Meanwhile, as illustrated in FIG. 18, when the drive control circuit 51-1 outputs the VBS control signal VBS_CNT1 of an L level, the transistor 471 of the VBS control signal output circuit 460 included in the drive control circuit 51-1 is turned on. Thus, the drive control circuit 51-1 outputs the ground potential supplied via the transistor 461 of the VBS control signal output circuit 460 as a signal of an L level. In this case, a potential of a wire through which the VBS control signal VBS_CNT1 is propagated becomes the ground potential via the transistor 461 included in the drive control circuit 51-1. Thus, the signal of an L level is input to the VBS supply control circuit 80-1 regardless of whether the transistor 461 included in the drive control circuit 51-2 is turned on or turned off.

Likewise, when the drive control circuit 51-2 outputs the VBS control signal VBS_CNT2 of an L level, the transistor 471 of the VBS control signal output circuit 460 included in the drive control circuit 51-2 is turned on. Thus, the drive control circuit 51-2 outputs the ground potential supplied via the transistor 461 of the VBS control signal output circuit 460 as a signal of an L level. In this case, a potential of a wire through which the VBS control signal VBS_CNT2 is propagated becomes the ground potential via the transistor 461 included in the drive control circuit 51-2. Thus, the signal of an L level is input to the VBS supply control circuit 80-1 regardless of whether the transistor 461 included in the drive control circuit 51-1 is turned on or turned off.

That is, when at least one of the VBS control signal VBS_CNT1 and the VBS control signal VBS_CNT2 is at an L level, a signal of an H level is input to the VBS supply control circuit 80-1. As a result, as illustrated in FIG. 15, the VBS supply control circuit 80-1 does not supply the reference voltage signal VBS1 to the ejecting modules 21-1 and 21-2 as the reference voltage signal VBS2-1. In other words, when at least one of the VBS control signal VBS_CNT1 and the VBS control signal VBS_CNT2 is a signal indicating that the reference voltage signal VBS1 is not supplied to the electrode 612 of the piezoelectric element 60 included in the ejecting module 21-1 and the electrode 612 of the piezoelectric element included in the ejecting module 21-2 as the reference voltage signal VBS2-1, the VBS supply control circuit 80-1 does not supply the reference voltage signal VBS1 to the electrode 612 of the piezoelectric element 60 included in the ejecting module 21-1 and the electrode 612 of the piezoelectric element 60 included in the ejecting module 21-2 as the reference voltage signal VBS2-1.

Likewise, in the VBS supply control circuit 80-2, one end to which the reference voltage signal VBS1 is input is electrically coupled to the terminal VBS-Out of the reference voltage signal output circuit 30, and the other end from which the reference voltage signal VBS2-2 is output is electrically coupled to the electrode 612 of the piezoelectric element 60 included in the ejecting module 21-3 and the electrode 612 of the piezoelectric element 60 included in the ejecting module 21-4. In this case, the other end of the VBS supply control circuit 80-2 is electrically coupled to the electrode 612 of the piezoelectric element 60 included in the ejecting module 21-1 and the electrode 612 of the piezoelectric element 60 included in the ejecting module 21-2. The VBS supply control circuit 80-2 switches whether or not to supply the reference voltage signal VBS1 to the electrode 612 of the piezoelectric element 60 included in the ejecting module 21-3 and the electrode 612 of the piezoelectric element 60 included in the ejecting module 21-4 as the reference voltage signal VBS2-2.

As illustrated in FIGS. 3A and 3B, the drive control circuit 51-3 is electrically coupled to the electrode 611 of the piezoelectric element 60 included in the ejecting module 21-3 via the selection circuit 230 included in the drive signal selection control circuit 200-3. The drive control circuit 51-3 is electrically coupled to the VBS supply control circuit 80-2 and outputs the VBS control signal VBS_CNT3 for controlling an operation of the VBS supply control circuit 80-2 to the VBS supply control circuit 80-2. Likewise, the drive control circuit 51-4 is electrically coupled to the electrode 611 of the piezoelectric element 60 included in the ejecting module 21-4 via the selection circuit 230 included in the drive signal selection control circuit 200-4. The drive control circuit 51-4 is electrically coupled to the VBS supply control circuit 80-2 and outputs the VBS control signal VBS_CNT4 for controlling the operation of the VBS supply control circuit 80-2 to the VBS supply control circuit 80-2.

In the same manner as the VBS supply control circuit 80-1, when both the VBS control signal VBS_CNT3 and the VBS control signal VBS_CNT4 are signals of an H level indicating that the reference voltage signal VBS1 is supplied to the ejecting modules 21-3 and 21-4 as the reference voltage signal VBS2-2, the VBS supply control circuit 80-2 supplies the reference voltage signal VBS1 to the electrode 612 of the piezoelectric element 60 included in the ejecting module 21-3 and the electrode 612 of the piezoelectric element 60 included in the ejecting module 21-4 as the reference voltage signal VBS2-2, and when at least one of the VBS control signal VBS_CNT3 and the VBS control signal VBS_CNT4 is a signal of an L level indicating that the reference voltage signal VBS1 is not supplied to the ejecting modules 21-3 and 21-4 as the reference voltage signal VBS2-2, the VBS supply control circuit 80-2 does not supply the reference voltage signal VBS1 to the electrode 612 of the piezoelectric element 60 included in the ejecting module 21-3 and the electrode 612 of the piezoelectric element 60 included in the ejecting module 21-4 as the reference voltage signal VBS2-2.

That is, the reference voltage signal output circuit is electrically coupled to the electrode 612 of the piezoelectric element 60 included in the ejecting module 21-1 and the electrode 612 of the piezoelectric element 60 included in the ejecting module 21-2 via the VBS supply control circuit 80-1, and is electrically coupled to the electrodes 612 of the piezoelectric element 60 included in the ejecting module 21-3 and the electrodes 612 of the piezoelectric element 60 included in the ejecting module 21-4 via the VBS supply control circuit 80-2. The VBS supply control circuit 80-1 controls whether or not to supply the reference voltage signal VBS1 to the ejecting modules 21-1 and 21-2 as the reference voltage signal VBS2-1, based on the VBS control signal VBS_CNT1 output by the drive control circuit 51-1 and the VBS control signal VBS_CNT2 output by the drive control circuit 51-2, and the VBS supply control circuit 80-2 controls whether or not to supply the reference voltage signal VBS1 to the ejecting modules 21-3 and 21-4 as the reference voltage signal VBS2-2, based on the VBS control signal VBS_CNT3 output by the drive control circuit 51-3 and the VBS control signal VBS_CNT4 output by the drive control circuit 51-4.

7. Effects

As described above, in a drive circuit according to the present embodiment, the drive signal VOUT1 based on the drive signal COM1 supplied from the drive control circuit 51-1 is supplied to the electrode 611 of the piezoelectric element 60 included in the head 22-1, and the drive signal VOUT2 based on the drive signal COM2 supplied from the drive control circuit 51-2 is supplied to the electrode 611 of the piezoelectric element 60 included in the head 22-2. Further, the reference voltage signal VBS2-1 based on the reference voltage signal VBS1 from the common reference voltage signal output circuit 30 is supplied to the electrode 612 of the piezoelectric element 60 included in the head 22-1 and the electrode 612 of the piezoelectric element 60 included in the head 22-2. The piezoelectric element 60 included in the head 22-1 is driven by a potential difference between the drive signal VOUT1 supplied to the electrode 611 and the reference voltage signal VBS2-1 supplied to the electrode 612, and the piezoelectric element 60 included in the head 22-2 is driven by a potential difference between the drive signal VOUT2 supplied to the electrode 611 and the reference voltage signal VBS2-1 supplied to the electrode 612. That is, the common reference voltage signal VBS2-1 is supplied to the piezoelectric element 60 included in the head 22-1 and the piezoelectric element 60 included in the head 22-2 as a common reference potential. Thereby, a possibility that a difference occurs in a drive reference potential of each of the piezoelectric element 60 included in the head 22-1 and the piezoelectric element 60 included in the head 22-2 is reduced, and as the result, drive accuracies of the piezoelectric element 60 included in the head 22-1 and the piezoelectric element 60 included in the head 22-2 are increased.

Further, supply of the reference voltage signal VBS2-1 supplied to the piezoelectric element 60 included in the head 22-1 and the piezoelectric element 60 included in the head 22-2 is controlled by one VBS supply control circuit 80. Thus, a possibility that a variation in the VBS supply control circuit 80 cause a variation in a drive reference potential of each of the piezoelectric element 60 included in the head 22-1 and the piezoelectric element 60 included in the head 22-2 is reduced, and as the result, drive accuracies of the piezoelectric element 60 included in the head 22-1 and the piezoelectric element 60 included in the head 22-2 are increased.

Furthermore, since the supply of the reference voltage signal VBS2-1 supplied to the piezoelectric element 60 included in the head 22-1 and the piezoelectric element 60 included in the head 22-2 is controlled by one VBS supply control circuit 80, when the voltage value of the reference voltage signal VBS2-1 is abnormal, it is not necessary to control a plurality of configurations for supplying the reference voltage signal VBS2-1, and it is possible to stop and restart supply to the piezoelectric element 60 included in the head 22-1 and the piezoelectric element 60 included in the head 22-2 in a short time and to enhance safety of the liquid ejecting apparatus 1.

Hereinbefore, although embodiments and modification examples are described above, the present disclosure is not limited to the embodiments and can be implemented in various forms without departing from the gist of the disclosure. For example, the above-described embodiments can be appropriately combined.

The present disclosure includes substantially the same configuration (for example, a configuration having the same function, method, and result, or a configuration having the same object and effect) as the configuration described in the embodiment. Further, the present disclosure includes a configuration in which a non-essential portion of the configuration described in the embodiment is replaced. Further, the present disclosure includes a configuration having the same action and effect as in the configuration described in the embodiment or a configuration capable of achieving the same object. Further, the present disclosure includes a configuration in which a known technology is added to the configuration described in the embodiment.

What is claimed is:

1. A drive circuit for driving a first drive element having a first terminal and a second terminal and driving a second drive element having a third terminal and a fourth terminal, comprising:

a first drive signal output circuit that is electrically coupled to the first terminal and outputs a first drive signal for driving the first drive element;

a second drive signal output circuit that is electrically coupled to the third terminal and outputs a second drive signal for driving the second drive element;

a reference voltage signal output circuit that is electrically coupled to the second terminal and the fourth terminal and outputs a reference voltage signal having a constant reference voltage value; and a first switch circuit having one end electrically coupled to an output terminal of the reference voltage signal output circuit and the other end electrically coupled to the second terminal and the fourth terminal, wherein the first switch circuit switches whether or not to supply the reference voltage signal to the second terminal and the fourth terminal, the first drive signal output circuit outputs a first control signal for controlling the first switch circuit, the second drive signal output circuit outputs a second control signal for controlling the first switch circuit, and the first switch circuit switches whether or not to supply the reference voltage signal to the second terminal and the fourth terminal according to the first control signal and the second control signal.

2. The drive circuit according to claim 1, wherein whether or not to supply the reference voltage signal to the second terminal and the fourth terminal is switched by controlling conduction or non-conduction between one end of the first switch circuit and the other end of the first switch circuit.

3. The drive circuit according to claim 1, wherein when at least one of the first control signal and the second control signal is a signal indicating that the reference voltage signal is not supplied to the second terminal and the fourth terminal, the first switch circuit does not supply the reference voltage signal to the second terminal and the fourth terminal.

4. The drive circuit according to claim 1, wherein the drive circuit further drives a third drive element having a fifth terminal and a sixth terminal, and a fourth drive element having a seventh terminal and an eighth terminal, the drive circuit further comprises a third drive signal output circuit that is electrically coupled to the fifth terminal and outputs a third drive signal for driving the third drive element, a fourth drive signal output circuit that is electrically coupled to the seventh terminal and outputs a fourth drive signal for driving the fourth drive element, and a second switch circuit having one end electrically coupled to the output terminal of the reference voltage signal output circuit and the other end electrically coupled to the sixth terminal and the eighth terminal, and the second switch circuit switches whether or not to supply the reference voltage signal to the sixth terminal and the eighth terminal.

5. A liquid ejecting apparatus comprising:

a liquid ejecting head that includes the first drive element and the second drive element and ejects a liquid by driving at least one of the first drive element and the second drive element; and the drive circuit according to claim 1.

* * * * *